US009946189B2

(12) United States Patent
Adachi et al.

(10) Patent No.: US 9,946,189 B2
(45) Date of Patent: Apr. 17, 2018

(54) DEVELOPING APPARATUS HAVING A LAYER THICKNESS REGULATION MEMBER, CARTRIDGE, AND IMAGE FORMING APPARATUS

(71) Applicant: CANON KABUSHIKI KAISHA, Tokyo (JP)

(72) Inventors: Motoki Adachi, Ashigarakami-gun (JP); Motonari Ito, Suntou-gun (JP); Takanori Watanabe, Kawasaki (JP); Yusuke Usui, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/366,206

(22) Filed: Dec. 1, 2016

(65) Prior Publication Data

US 2017/0082945 A1 Mar. 23, 2017

Related U.S. Application Data

(62) Division of application No. 14/624,654, filed on Feb. 18, 2015, now Pat. No. 9,541,857.

(30) Foreign Application Priority Data

Feb. 18, 2014 (JP) ..... 2014-028617
Dec. 3, 2014 (JP) ..... 2014-245404
(Continued)

(51) Int. Cl.
*G03G 15/08* (2006.01)
*G03G 21/00* (2006.01)

(52) U.S. Cl.
CPC ..... *G03G 15/0812* (2013.01); *G03G 21/0064* (2013.01)

(58) Field of Classification Search
CPC ..... G03G 15/0812; G03G 15/0887; G03G 15/0889; G03G 15/081; G03G 21/0064; G03G 2215/0844
(Continued)

(56) References Cited

U.S. PATENT DOCUMENTS 5,721,433 A 2/1998 Kosaka
6,337,956 B1 1/2002 Sato et al.
(Continued)

FOREIGN PATENT DOCUMENTS

EP 2 657 787 A2 10/2013
JP 80137264 A 5/1996
(Continued)

OTHER PUBLICATIONS

Korean Office Action dated Mar. 8, 2017, in related Korean Patent Application No. 10-2015-0024482.

*Primary Examiner* — Robert Beatty
(74) *Attorney, Agent, or Firm* — Fitzpatrick, Cella, Harper & Scinto

(57) ABSTRACT

A developing apparatus includes a developer bearing member configured to bear a developer on a surface, a regulating member that regulates layer thickness of the developer on the developer bearing member, and a developer conveying member. In addition, a frame has a development chamber in which the developer bearing member and the regulating member are provided, a storage chamber in which the conveying member is provided and the developer is stored, and an opening through which the developer passes into the development chamber. The developing apparatus collects the developer remaining on the developer bearing member into the storage chamber after the developer on the developer bearing member is transferred onto a transfer material. The regulating material includes a step portion that forms a
(Continued)

gap between the regulating member and the developer bearing member.

19 Claims, 16 Drawing Sheets

(30) Foreign Application Priority Data

Feb. 12, 2015 (JP) ..... 2015-025629
Feb. 13, 2015 (JP) ..... 2015-026931

(58) Field of Classification Search
USPC ..... 399/149, 150, 272, 281, 284
See application file for complete search history.

(56) References Cited

U.S. PATENT DOCUMENTS 6,621,996 B1 9/2003 Meyer
6,654,579 B2 11/2003 Shakuto
7,031,641 B2 4/2006 Nakahara et al.
7,251,441 B2 7/2007 Hagiwara et al.
7,379,693 B2 5/2008 Ogawa et al.
7,693,451 B2 * 4/2010 Sato ..... G03G 15/0806 399/119
8,005,404 B2 * 8/2011 Sato ..... G03G 15/0896 399/252
2001/0031154 A1 10/2001 Sato
2002/0141783 A1 10/2002 Ishiyama et al.
2002/0159782 A1 10/2002 Tsuruya
2003/0063919 A1 4/2003 Kakeshita
2007/0206965 A1 9/2007 Namiki et al.
2011/0158710 A1 6/2011 Shiraki et al.
2011/0176828 A1 7/2011 Lee et al.
2013/0136507 A1 * 5/2013 Kato ..... G03G 15/0808 399/281
2013/0259530 A1 * 10/2013 Kato ..... G03G 15/0832 399/254
2013/0315621 A1 11/2013 Toriyama et al.
2015/0117903 A1 4/2015 Handa
2017/0068186 A1 * 3/2017 Tanaka ..... G03G 15/0889

FOREIGN PATENT DOCUMENTS

JP H08-136439 A 5/1996
JP H11-109822 A 4/1999
JP 2001-005276 A 1/2001
JP 2002-214887 A 7/2002
JP 2003-316122 A 11/2003
JP 2004-354978 A 12/2004
JP 2005-092146 A 4/2005
JP 2005-283845 A 10/2005
JP 2006-251730 A 9/2006
JP 2006-271614 A 10/2006
JP 2006-301108 A 11/2006
JP 4630707 B2 2/2011
JP 04785407 B2 10/2011

* cited by examiner

DEVELOPING APPARATUS HAVING A LAYER THICKNESS REGULATION MEMBER, CARTRIDGE, AND IMAGE FORMING APPARATUS

This application is a divisional of application Ser. No. 14/624,654, filed Feb. 18, 2015.

BACKGROUND OF THE INVENTION

Field of the Invention

The present invention relates to a developing apparatus, a cartridge, a process cartridge, and an image forming apparatus. The developing apparatus includes at least a developer bearing member that bears a developer. The developing apparatus sometimes includes, for example, a frame body for storing the developer and a conveying member that conveys the developer. The cartridge is a component in which a plurality of components in the image forming apparatus are integrated to be detachably attached to an image forming apparatus main body. The process cartridge includes at least an image bearing member that bears a developer image. In particular, a component in which the image bearing member and process means acting on the image bearing member are integrated is called a process cartridge. The image forming apparatus is an apparatus that forms an image on a recording material (a transfer material), and in particular, an apparatus that adopts an electrophotographic system.

Description of the Related Art

Conventionally, in image forming apparatuses such as an electrophotographic apparatus and an electrostatic recording apparatus, from the viewpoint of simplification of apparatus configurations and elimination of wastes, a cleaner-less system (a toner recycle system) has been proposed. In the cleaner-less system, a dedicated drum cleaner, which is surface cleaning means after a transfer process of a photosensitive body, in an image forming apparatus of a transfer system is removed. Therefore, an untransferred toner on the photosensitive body after the transfer process is cleaned and removed from the photosensitive body by a developing apparatus and collected into the developing apparatus.

In particular, cleaning performed simultaneously with development in the developing apparatus is called development simultaneously cleaning. The development simultaneous cleaning is a method of collecting the toner remaining on the photosensitive body after the transfer process with fog removing bias (a fog removing potential difference Vback, which is a potential difference between a direct-current voltage applied to the developing apparatus and the surface potential of the photosensitive body) during development in the next and subsequent processes. With this method, the untransferred toner is collected into the developing apparatus and reused in the next and subsequent processes. Therefore, it is possible to eliminate a waste toner and reduce labor required for maintenance. Since the image forming apparatus is cleaner-less, a cleaner mechanism is not separately provided. There is a significant advantage in terms of space. It is possible to greatly reduce the size of the image forming apparatus (Japanese Patent No. 4510493, Japanese Patent No. 4785407, Japanese Patent Application Laid-open No. 2004-354978, and Japanese Patent No. 4630707 (FIG. 14)).

When the cleaner-less system is adopted, when the toner is recycled, it is likely that foreign matters such as paper powder enter the developing apparatus and an image failure is caused by the foreign matters. For example, a representative image failure is a streak-like image failure that occurs because the paper powder and the foreign matters are held between a regulating blade and a developing sleeve and a uniform toner layer is disturbed. Besides, it is also likely that black spots occur in a white background portion of paper or, conversely, white spots occur in a printed portion because the paper powder is developed together with the toner.

Therefore, as the developing apparatus adopted in the cleaner-less system, a one-component magnetic contact developing system is proposed (Japanese Patent No. 4510493). In this system, a magnetic developer (a magnetic toner) is born on a developing sleeve (a developer conveying member), which includes magnetic field generating means, and brought into contact with the surface of a photosensitive member to perform development. The magnetic toner in the developing apparatus is carried to the vicinity of the developing sleeve by a mechanical supplying mechanism or the gravity and finally supplied to the developing sleeve by magnetism. The magnetic toner supplied to the developing sleeve is regulated to a proper amount by the regulating blade disposed in contact with the developing sleeve and forms a uniform toner layer. DC bias is applied between developing rollers.

In such a developing apparatus, the magnetic toner is supplied to the developing sleeve using the magnetism. Therefore, it is possible to more preferentially supply the toner to the developing sleeve than the paper powder that does not have magnetism. Therefore, an image is less easily affected by the paper powder than in a cleaner-less system that adopts a non-magnetic contact developing method.

On the other hand, when it is attempted to increase the life of the cleaner-less system, fogging performance is sometimes deteriorated by recycling of the toner. While an image forming process is repeated, triboelectric charging characteristics of the toner are deteriorated. Proper electric charges cannot be applied to the toner by the regulating blade. As a result, fogging is sometimes worsened. The fogging means an image failure in which the toner is slightly developed in a white portion (an unexposed portion) that is originally not printed.

On the other hand, there is proposed a method of applying, to the regulating blade, bias (blade bias) on the same polarity side as the toner with respect to developing bias and providing a potential difference between the regulating blade and the developing sleeve to facilitate application of electric charges to the toner with an electric field in a contact region (Japanese Patent No. 4785407). The application of electric charges to the toner is facilitated by the blade bias. Even after a long period of use, the appropriate electric charges are applied to the toner. The fogging is less easily worsened.

On the other hand, a cleaner-less system that adopts a contact charging system, in which a charging roller is used, is proposed (Japanese Patent Application Laid-open No. 2004-354978). When the contact charging system is used in the cleaner-less system, a charging failure is caused by adhesion of the toner to the charging roller, which is a charging member. As a method of reducing the adhesion of the toner to the charging member, it is known to drive the charging member to provide a circumferential speed difference between the charging member and a photosensitive drum. It is also known to provide optical discharging means in view of stability of a charging process and memory removal.

SUMMARY OF THE INVENTION

However, in recent years, users are becoming more diversified and types of paper in use are also diversified. Among various types of paper, there could be paper that produces a lot of paper powder. There could also be paper that produces other foreign matters besides foreign matters of the paper powder. Therefore, it is still likely that such foreign matters affect image formation.

In order to solve the problem, a developing apparatus of the present invention comprising:

a developer bearing member configured to bear a developer on a surface;

a regulating member configured to come into contact with the developer bearing member and regulate layer thickness of the developer born on the surface of the developer bearing member;

a development chamber provided with the developer bearing member and the regulating member and having an opening;

a storage chamber configured to store the developer; and a conveying member provided in the storage chamber and configured to convey the developer stored in the storage chamber to the development chamber through the opening, the developing apparatus collecting, after the developer on the image bearing member is transferred onto a transfer material, the developer remaining on the image bearing member into the storage chamber, wherein a corner portion of a distal end portion of the regulating member comes into contact with the developer bearing member, a bottom section of the development chamber is located above a bottom section of the storage chamber in a vertical direction, and a contact region of the developer bearing member in contact with the regulating member is located immediately above the opening in the vertical direction.

In order to solve the problem, a developing apparatus of the present invention comprising:

a developer bearing member configured to bear a developer on a surface;

a regulating member configured to come into contact with the developer bearing member and regulate layer thickness of the developer born on the surface of the developer bearing member;

a development chamber provided with the developer bearing member and the regulating member and having an opening;

a storage chamber configured to store the developer; and a conveying member provided in the storage chamber and configured to convey the developer stored in the storage chamber to the development chamber through the opening, the developing apparatus collecting, after the developer on the image bearing member is transferred onto a transfer material, the developer remaining on the image bearing member into the storage chamber, wherein the regulating member includes, further on a downstream side in a rotating direction of the developer bearing member than a contact region where the regulating member is in contact with the developer bearing member, a step portion that forms a gap between the regulating member and the developer bearing member.

In order to solve the problem, a cartridge of the present invention detachably provided in a main body of an image forming apparatus that performs image formation, the cartridge comprising:

the developing apparatus; and an image bearing member to which the developer is supplied by the developer bearing member to develop an electrostatic latent image formed on a surface of the image bearing member into a developer image.

In order to solve the problem, an image forming apparatus of the present that performs image formation, comprising:

the developing apparatus; and an image bearing member to which the developer is supplied by the developer bearing member to develop an electrostatic latent image formed on a surface of the image bearing member into a developer image, or comprising the cartridge.

In order to solve the problem, a process cartridge of the present invention comprising:

an image bearing member;

a contact charging member configured to charge a surface of the image bearing member;

an optical discharging section disposed on an upstream side of the contact charging member in a rotating direction of the image bearing member; and a developing apparatus configured to collect, after a developer image formed on the image bearing member is transferred onto a transfer material, the developer remaining on the image bearing member, wherein the contact charging member is driven to cause a circumferential speed difference between a surface of the contact charging member and the surface of the image bearing member, and a contact region of the image bearing member in contact with the contact charging member is located below the optical discharging section in a vertical direction.

In order to solve the problem, a process cartridge of the present invention comprising:

an image bearing member;

a contact charging member configured to charge a surface of the image bearing member;

an optical discharging section disposed on an upstream side of the contact charging member in a rotating direction of the image bearing member; and a developing apparatus configured to collect, after a developer image formed on the image bearing member is transferred onto a transfer material, the developer remaining on the image bearing member, wherein the contact charging member is driven to cause a circumferential speed difference between a surface of the contact charging member and the surface of the image bearing member, and a contact region of the image bearing member in contact with the contact charging member is located on an opposite side to the optical discharging section across a straight line connecting a vertex and a rotation center of the image bearing member when viewed in a rotation axis direction of the image bearing member.

In order to solve the problem, a cartridge of the present invention used together with a developing apparatus that collects, after a developer image formed on an image bearing ember is transferred onto a transfer material, a developer remaining on the image bearing member, the cartridge comprising:

a contact charging member configured to charge a surface of the image bearing member; and an optical discharging section disposed on an upstream side of the contact charging member in a rotating direction of the image bearing member, wherein the contact charging member is driven to cause a circumferential speed difference between a surface of the contact charging member and the surface of the image bearing member, and the optical discharging member is located above a contact region of the contact charging member in contact with the image bearing member in a vertical direction.

In order to solve the problem, a cartridge of the present invention used together with a developing apparatus that collects, after a developer image formed on an image bearing ember is transferred onto a transfer material, a developer remaining on the image bearing member, the cartridge comprising:

a contact charging member configured to charge a surface of the image bearing member; and an optical discharging section disposed on an upstream side of the contact charging member in a rotating direction of the image bearing member, wherein the contact charging member is driven to cause a circumferential speed difference between a surface of the contact charging member and the surface of the image bearing member, and the optical discharging member is located on an opposite side to a contact region of the contact charging member in contact with the image bearing member, across a straight line connecting a vertex and a rotation center of the image bearing member when viewed in a rotation axis direction of the image bearing member.

In order to solve the problem, an image forming apparatus of the present invention comprising the process cartridge, the process cartridge being detachably attached to an apparatus main body.

In order to solve the problem, an image forming apparatus of the present invention comprising:

an image bearing member;

the cartridge detachably attached to an apparatus main body; and a developing apparatus configured to collect, after a developer image formed on the image bearing member is transferred onto a transfer material, a developer remaining on the image bearing member.

According to the present invention, it is possible to reduce the influence on image formation due to foreign matters.

Further features of the present invention will become apparent from the following description of exemplary embodiments with reference to the attached drawings.

DESCRIPTION OF THE EMBODIMENTS

Modes for carrying out the present invention are illustratively explained in detail below on the basis of embodiment with reference to the drawings. However, dimensions, materials, and shapes of components described in the embodiments, relative arrangement of the components, and the like should be changed as appropriate according to the configuration of an apparatus to which the invention is applied and various conditions. That is, the dimensions, the materials, the shapes, and the relative arrangement are not intended to limit the scope of the present invention to the embodiments.

(First Embodiment)

<Overview of the Overall Configuration of an Image Forming Apparatus>

Figure 2:
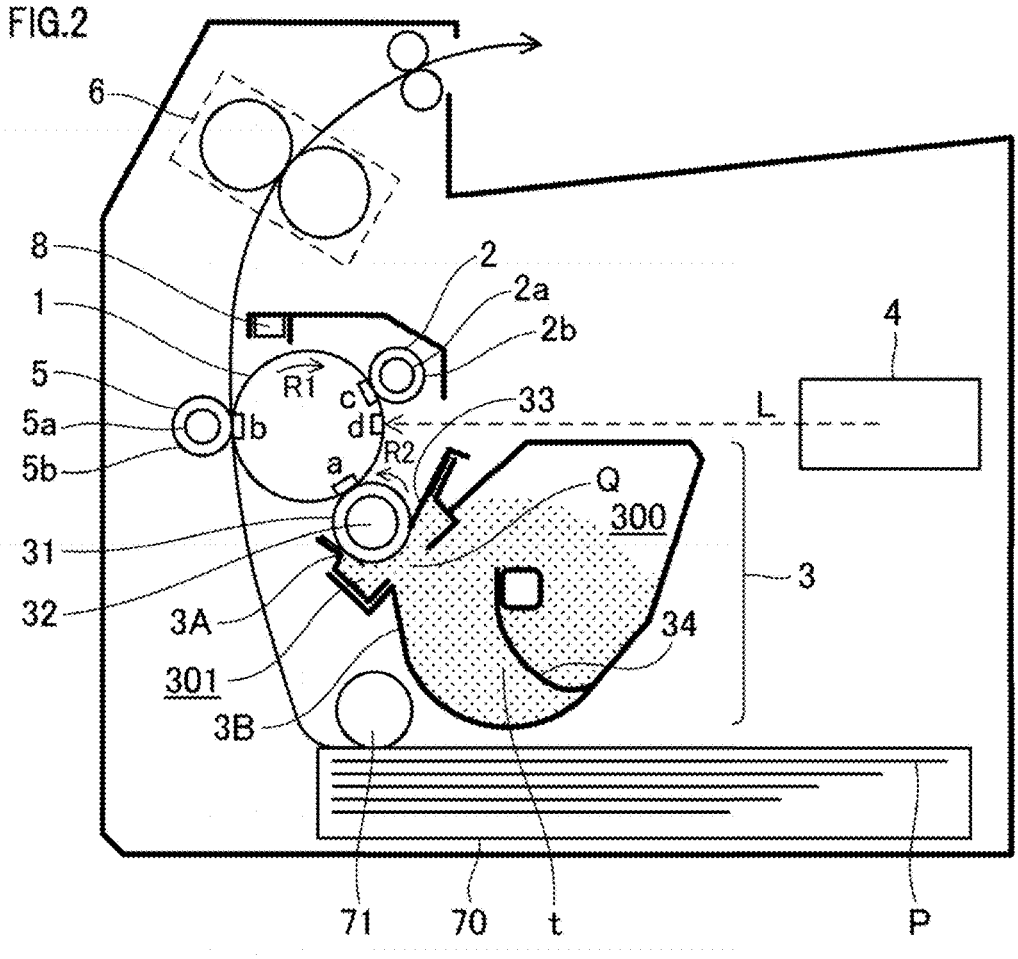
FIG. 2 is a schematic sectional view showing the overall configuration of an image forming apparatus according to the first embodiment.

First, an overview of the overall configuration of an image forming apparatus according to this embodiment is explained with reference to FIG. 2. FIG. 2 is a schematic sectional view showing the overall configuration of an image forming apparatus according to this embodiment. In this embodiment, as the image forming apparatus, a monochrome laser printer employing a transfer electrophotographic process is explained.

The image forming apparatus according to this embodiment includes, as main components, a photosensitive drum 1 functioning as an image bearing member, a charging roller 2 functioning as charging means, a developing apparatus 3, a laser beam scanner 4 functioning as exposing means, a transfer roller 5 functioning as a transfer member, and a fixing apparatus 6. The image forming apparatus according to this embodiment detachably includes a process cartridge in which the photosensitive drum 1, the charging roller 2, the developing apparatus 3, and the like are provided as a cartridge.

The photosensitive drum 1 in this embodiment is an OPC photosensitive body having a diameter of φ24 mm and negative polarity. The photosensitive drum 1 is provided to be rotatable in an arrow R1 direction in FIG. 2 at circumferential speed (process speed or printing speed) of 100 mm/sec.

The charging roller 2 charges the surface of the photosensitive drum 1. The charging roller 2 is a conductive elastic roller and includes a cored bar 2*a* and a conductive elastic layer 2*b* that covers the cored bar 2*a*. The charging roller 2 is in press-contact with the photosensitive drum 1 at a predetermined pressing force. A portion of the surface of the photosensitive drum 1 in press-contact with the charging roller 2 (a contact region) is referred to as charging section c. A charging nip is formed by the charging section c and the contact region in contact with the photosensitive drum 1 in the charging roller 2. The charging roller 2 rotates following the rotation of the photosensitive drum 1.

The image forming apparatus according to this embodiment includes a charging power supply that applies charging bias to the charging roller 2. The charging power supply applies a direct-current voltage to the cored bar 2*a* of the charging roller 2. The direct-current voltage is set such that a potential difference between the surface potential of the photosensitive drum 1 and the potential of the charging roller 2 is equal to or larger than a discharge start voltage. Specifically, as the charging bias, a direct-current voltage of −1300 V is applied from the charging power supply. At this point, the surface potential (dark part potential) of the photosensitive drum 1 is uniformly charged to −700 V.

The laser beam scanner 4 includes a laser diode and a polygon mirror. The laser beam scanner 4 outputs a laser beam L intensity-modulated according to a time-series electric digital pixel signal of target image information and scans and exposes the charged surface of the photosensitive drum 1 by the laser beam L. Laser power of the laser beam scanner 4 is adjusted such that the surface potential of the photosensitive drum 1 changes to −150 V when the entire surface of the photosensitive drum 1 is exposed by the laser beam L.

Figure 1:
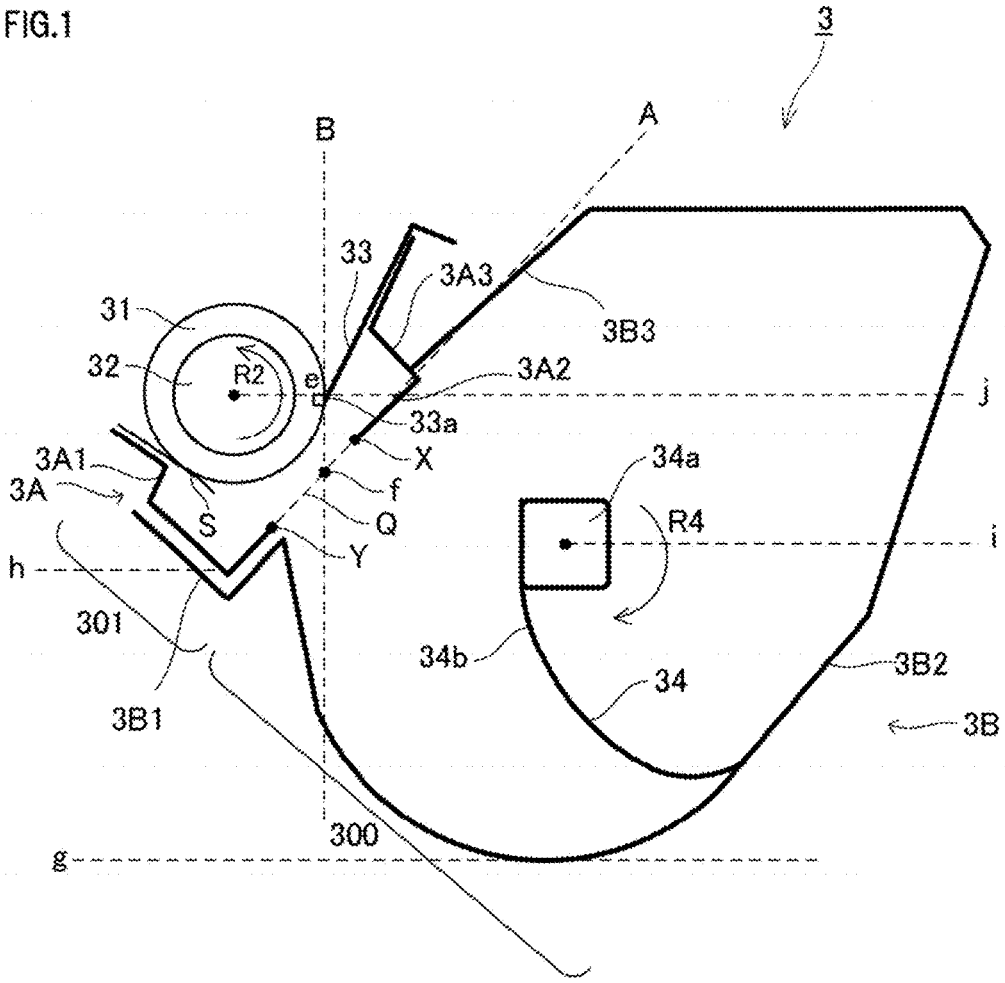
FIG. 1 is a schematic sectional view showing the configuration of a developing apparatus according to a first embodiment.

The developing apparatus 3 includes a development chamber 301 configured by a first frame body 3A and a toner storage chamber 300 configured by a second frame body 3B. As shown in FIG. 1, the first frame body 3A includes a portion 3A1 having an opening lower end portion Y explained below, a portion 3A2 having an opening upper end portion X explained below, and a portion 3A3. The second frame body 3B includes a portion 3B1 located on the outer side of the portion 3A1 of the first frame body 3A, a portion 3B2 forming a most portion of the toner storage chamber 300, and a portion 3B3 located on the outer side of the portion 3A3 of the first frame body 3A. In the development chamber 301, a developing sleeve 31 functioning as a developer conveying member and a regulating blade 33 functioning as a regulating member are provided. A magnetic toner t functioning as a magnetic developer is stored in the toner storage chamber 300. Note that details of the configuration of the developing apparatus 3 are explained below.

The magnetic toner t is attracted to the surface of the developing sleeve 31 by the magnetism of a magnet roller 32 functioning as magnetic field generating means included in the developing sleeve 31. The magnetic toner t is charged with fixed triboelectric charges. The magnetic toner t visualizes an electrostatic latent image on the photosensitive drum 1 (on the image bearing member) in a developing section a with developing bias applied between the developing sleeve 31 and the photosensitive drum 1 by a developing bias application power supply. In this embodiment, the developing bias is set to −350 V. Note that the developing section a is a region of the surface of the photosensitive drum 1 opposed to the developing sleeve 31 and is a region to which the magnetic developer is supplied by the developing sleeve 31.

The transfer roller 5 having intermediate resistance is present as contact transfer means. The transfer roller 5 is provided in press-contact with the photosensitive drum 1 at predetermined pressure. A portion of the surface of the photosensitive drum 1 in press-contact with the transfer roller 5 (a contact region) is referred to as transfer section b. A transfer nip is formed by the transfer section b and the contact region in contact with the photosensitive drum 1 in the transfer roller 5. The transfer roller 5 in this embodiment is configured by a cored bar 5*a* and an intermediate resistance foamed layer 5*b* that covers the cored bar 5*a*. A roller having a roller resistance value of $5\times10^{8}\Omega$ is used as the transfer roller 5. A voltage of +2.0 kV is applied to the cored bar 5*a*. A toner image formed on the photosensitive drum 1 as a developer image is transferred onto paper P serving as a transfer material.

The fixing apparatus 6 heats and pressurizes the paper P passed through the transfer section b and having the toner image transferred thereon to thereby fix the toner image on the paper P. Thereafter, the paper P having the toner image fixed thereon is discharged to the outside of the apparatus.

<Image Forming Process>

An overview of an image forming process is explained with reference to FIG. 2. First, when a print signal is input to a controller of an image forming apparatus main body, the image forming apparatus starts an image forming operation. Driving sections start to operate at predetermined timing and a voltage is applied. The photosensitive drum 1 driven to rotate is uniformly charged by the charging roller 2. The uniformly-charged photosensitive drum 1 is exposed by the laser beam L from the scanner section 4. An electrostatic latent image is formed on the surface of the photosensitive drum 1. Thereafter, a toner (a developer) is supplied to the electrostatic latent image by the developing sleeve 31. The electrostatic latent image is visualized as a toner image (a developer image).

On the other hand, the paper P is separated and fed from a transfer material storing section 70 by a transfer material supply unit 71 and delivered to a transfer region a in synchronization with timing for forming the toner image on the photosensitive drum 1. In this way, the visualized toner image on the photosensitive drum 1 is transferred onto the paper P by the action of the transfer roller 5. The paper P serving as a transfer material having the toner image transferred thereon is conveyed to the fixing apparatus 6. The unfixed toner image on the paper P is fixed to the paper P by heat and pressure. Thereafter, the paper P is discharged to the outside of the apparatus by a discharge roller or the like.

<Cleaner-less System>

A cleaner-less system in this embodiment is explained in detail. In this embodiment, a so-called cleaner-less system is adopted in which a cleaning member that removes, from the photosensitive drum 1, an untransferred toner remaining on the photosensitive drum 1 without being transferred is not provided.

The untransferred toner remaining on the photosensitive drum 1 after a transfer process is charged in negative polarity like the photosensitive drum 1 by electric discharge in an air gap section before the charging nip. At this point, the surface of the photosensitive drum 1 is charged to −700 V. The untransferred toner charged in the negative polarity passes through the charging nip without adhering to the charging roller 2 because of a relation of a potential difference (the photosensitive drum surface potential=−700 V and charging roller potential=−1300 V).

The untransferred toner passed through the charging nip reaches a laser irradiation position d of the surface of the photosensitive drum 1 where a laser beam is irradiated. Since the untransferred toner does not remain in such a large amount as to block the laser beam of the exposing means, the untransferred toner does not affect a process for forming the electrostatic latent image on the photosensitive drum 1. The toner in a non-exposed section (the photosensitive drum surface not subjected to the laser irradiation) of the toner passed through the laser irradiation position d is collected by the developing sleeve 31 with an electrostatic force in the developing section a.

On the other hand, the toner in an exposed section (the photosensitive drum surface subjected to the laser irradiation) of the toner passed through the laser irradiation position d continues to be present on the photosensitive drum 1 without being electrostatically collected. However, a part of the toner is sometimes collected by a physical force due to a circumferential speed difference between the developing sleeve 31 and the photosensitive drum 1. The toner remaining on the photosensitive drum 1 without being transferred onto the paper P in this way is generally collected into the developing apparatus 3. The toner collected into the developing apparatus 3 is mixed with the toner remaining in the developing apparatus 3 and re-used.

(Measures Against Stains of the Charging Roller)

In this embodiment, two configurations explained below are adopted in order to cause the untransferred toner to pass through the charging nip without adhering to the changing roller 2.

First, as shown in FIG. 2, an optical discharging member 8 is provided between the transfer roller 5 and the charging roller 2 in the rotating direction of the photosensitive drum 1. In order to perform stable electric discharge in the charging nip, the optical discharging member optically discharges the surface potential of the photosensitive drum 1 after the untransferred toner passes through the transfer nip. The potential of the photosensitive drum 1 before charging is set to about −150 V in an entire longitudinal region by the optical discharging member 8. This makes it possible to perform uniform electric discharge during the charging and uniformly charge the untransferred toner in negative polarity. As a result, the untransferred toner passes through the charging nip.

Second, the charging roller 2 is driven to rotate with a predetermined circumferential speed difference provided between the charging roller 2 and the photosensitive drum 1. Although most of the toner is charged in negative polarity by the electric discharge as explained above, the toner not charged in the negative polarity slightly remains. The toner sometimes adheres to the charging roller 2 in the charging nip. Therefore, by driving to rotate the charging roller 2 and the photosensitive drum 1 with the predetermined circumferential speed difference provided therebetween, it is possible to charge such a toner in the negative polarity with rubbing of the photosensitive drum 1 and the charging roller 2. Consequently, there is an effect of suppressing the adhesion of the toner to the charging roller 2. In this embodiment, a charging roller gear is provided in the cored bar 2*a* of the charging roller. The charging roller gear engages with a drum gear provided at a photosensitive drum end portion. Therefore, as the photosensitive drum 1 is driven to rotate, the charging roller 2 is also driven to rotate. The circumferential speed of the surface of the charging roller 2 is set to be 115% with respect to the circumferential speed of the surface of the photosensitive drum 1. The circumferential speed difference is 15% in this embodiment but is preferably within a range of 5% to 20%. This is because, if an excessively large circumferential speed difference is provided, a shaved amount of the roller increases and a period of use of the roller decreases.

In such a cleaner-less system, in particular, in the configuration in which the toner image is directly transferred from the photosensitive drum 1 onto the paper P as in this embodiment, paper powder or the like produced from the paper sometimes adheres to the surface of the photosensitive drum 1 and is collected into the developing apparatus 3. When the paper powder collected into the developing apparatus 3 is held between the regulating blade 33 and the developing sleeve 31 in a regulating section e, the paper powder disturbs the toner coat on the developing sleeve 31. The paper powder slipping through the regulating section e and coated on the developing sleeve 31 together with the toner is not charged in regular charging polarity or is coagulated with the toner. Therefore, the paper powder appears as black spots on the photosensitive drum 1 in a portion where the toner does not have to be developed. Conversely, when the paper powder is developed together with the toner, only the portions of the paper powder are not colored and appear as white spots. Note that the regulating section e is a portion of the developing sleeve 31 in contact with the regulating blade 33 (a development contact region).

Note that, in this embodiment, since the paper is used as the transfer material, problems due to the paper powder are explained. However, the present invention is not limited to this. For example, concerning problems caused by foreign matters such as plastic powder produced when a plastic sheet or the like is used as the transfer material, effects can also be obtained by adopting the configuration of the present invention.

<Explanation of the Developing Apparatus>

Details of the developing apparatus according to this embodiment for reducing the problems that occur when the cleaner-less system explained above is adopted are explained with reference to FIG. 1. FIG. 1 is a schematic sectional view showing the configuration of the developing apparatus according to this embodiment.

As shown in FIG. 1, the developing apparatus 3 includes the toner storage chamber 300 in which the toner is stored and the development chamber 301 including the developing sleeve 31.

In the developing sleeve 31, a conductive elastic layer having thickness of about 500 μm is formed on the outer circumference of a nonmagnetic sleeve functioning as a supporting section formed by a pipe of aluminum or stain-less steel. The developing sleeve 31 is supported by the development chamber 301 to be rotatable in an arrow R2 direction. The developing sleeve 31 is formed such that the outer diameter thereof is φ11 mm and the surface roughness thereof is usually 1.5 to 4.5 μm in average in Ra of the JIS standard. The developing sleeve 31 is pressed in the direction toward the photosensitive drum 1 to come into contact with the photosensitive drum 1. In the developing sleeve 31, penetration level regulating rollers are disposed at both end portions in the longitudinal direction (the axial direction) of the developing sleeve 31. By setting these rollers in contact with the photosensitive drum 1, a penetration level of the developing sleeve 31 and the surface of the photosensitive drum 1 is set to a predetermined value.

A developing sleeve gear is fixed to one end portion of the developing sleeve 31. A driving force is transmitted to the developing sleeve gear from a driving source of the image forming apparatus main body via a plurality of gears. The developing sleeve 31 is driven to rotate. The surface of the developing sleeve 31 is rotated in a forward direction with a speed difference of 140% with respect to the surface circumferential speed of the photosensitive drum 1. The surface of the developing sleeve 31 has appropriate surface roughness to be capable of bearing and conveying a predetermined amount of the toner.

The magnet roller 32 is disposed on the inner side of the developing sleeve 31. As the magnet roller 32, a four-pole magnet roll formed in a cylindrical shape and having N poles and S poles alternately disposed in the circumferential direction thereof is used. The four poles are a development pole opposed to the photosensitive drum 1, a regulation pole opposed to the regulating blade 33, a supply pole for supplying the toner in the development chamber 301 to the developing sleeve 31, and a leak prevention pole in an opposed section of a toner blowout prevention sheet S. As magnetic flux densities of the poles, the magnetic flux density of the regulation pole is the highest at 70 mT. The magnetic flux densities of the other poles are about 50 mT. The magnet roller 32 is fixedly disposed on the inner side of the developing sleeve 31 unlike the developing sleeve 31 rotating in the arrow R2 direction.

The regulating blade 33 is a tabular blade formed of SUS, phosphor bronze, or the like having thickness of, for example, about 100 μm. The proximal end portion of the regulating blade 33 is fixed to a support sheet metal and the distal end portion 33*a* with some curvature of the regulating blade 33 is set in contact with the surface of the developing sleeve 31 at predetermined pressure. The distal end portion of the regulating blade 33 is set in contact with the surface of the developing sleeve 31 such that a force of the contact is set to be about 20 gf/cm to 40 gf/cm (a contact load per 1 cm in the longitudinal direction of the developing sleeve 31). In the first embodiment, a distal end portion 33*a* at a free end of the regulating blade 33 having a curvature of about 0.2 mm is set in contact with the developing sleeve 31. The curvature of the distal end portion 33*a* is preferably 2 mm or below from a view point of regulating force of layer thickness.

The regulating blade 33 regulates the layer thickness of the toner attracted to the surface of the developing sleeve 31 by the magnetism of the magnet roller 32. The toner born on the surface of the developing sleeve 31 is applied with appropriate electric charges by triboelectric charging by rubbing between the developing sleeve 31 and the regulating blade 33 when the layer thickness is regulated by the regulating blade 33. Further, the toner is carried to a region opposed to the developing section a of the photosensitive drum 1. At this point, developing bias (−350 V) is applied to the developing sleeve 31 from a direct-current power supply. In the developing section a, the toner on the developing sleeve 31 electrostatically adheres to an electrostatic latent image formed on the surface of the photosensitive drum 1 with a potential difference between the potential of the surface of the photosensitive drum 1 and the potential of the developing sleeve 31. In this way, the electrostatic latent image is developed as a toner image.

A toner conveying member 34 is rotatably disposed in the toner storage chamber 300 (in a storage chamber). The toner conveying member 34 loosens the toner in the toner storage chamber 300 and conveys the toner to the development chamber 301. As shown in FIG. 1, the toner conveying member 34 is configured from a shaft bar member 34*a* attached with a backup formed of a resin material and a PPS film sheet 34*b*. As shown in FIG. 1, the regulating section e is provided above in the vertical direction of the axial center of the toner conveying member 34. The toner conveying member 34 rotates in an arrow R4 direction in FIG. 1 around both end portions thereof. In general, a driving force for rotating the toner conveying member 34 is used by, for example, being reduced to appropriate rotating speed by a gear train from the developing sleeve gear explained above.

In this embodiment, a magnetic one-component toner having negative charging performance is used as the toner. The toner is obtained by including wax or the like in 100 parts by weight of binder resin (styrene n—butylacrylate copolymer) with 80 parts by weight of magnetic body particles contained as a main component. An average particle diameter of the toner is 7.5 μm. As an external additive, 1.2 parts by weight of silica fine powder is used. When such a toner is used in the developing apparatus 3 having the configuration explained above, a toner coat amount on the developing sleeve 31 is about 0.4 mg/cm$^2$ to 0.9 mg/cm$^2$.

A weigh-average particle diameter of the toner is explained. As a measuring apparatus, a Coulter Counter TA-II type (manufactured by Beckman Coulter, Inc.) is used. A 1% NaCl water solution is prepared as an electrolytic solution using first-grade sodium chloride. As a measuring method, 0.1 to 0.5 ml of a surfactant is added to 100 to 150 ml of the electrolytic water solution as a dispersing agent. Further, 2 to 20 ml of a measurement sample is added. The electrolytic solution suspended with the sample is subjected to dispersion treatment by an ultrasonic dispersion device. A particle size distribution is measured with reference to the number of particles by the Coulter Counter using a 100 μm aperture as an aperture. Consequently, a weight-average particle diameter is calculated.

A degree of agglomeration of the toner in use is preferably equal to or lower than 40 in a state before use and is equal to or lower than 55 throughout a period of use. A measuring method for the degree of agglomeration is explained below.

(1) Measurement of a Degree of Agglomeration of the Toner

A degree of agglomeration of the toner was measured using a Powder Tester (manufactured by Hosokawa Micron Corporation). Sieves were set on the Powder Tester in three stages in order of a sieve of 200 mesh (an aperture of 77 μm and a wire diameter of 50 μm), a sieve of 373 mesh (an aperture of 38 μm and a wire diameter of 30 μm) and a sieve of 635 mesh (an aperture of 20 μm and a wire diameter of 20 μm) from the top. Them, 2 g of a weighed sample was gently placed on the sieves, vibration was given to the sample at amplitude of 1.5 mm for five seconds, the weights of the toner remaining on the sieves were measured, and a degree of agglomeration of the toner was calculated according to the following formula.

An amount of the weighed sample is represented as K, an amount of the toner on the mesh at the top stage is represented as L, an amount of the toner on the mesh at the middle stage is represented as M, and an amount of the toner on the mesh at the bottom stage is represented as N. In this case, when X=L/K, Y=M/K×0.6, and Z=N/K×0.2, the degree of agglomeration (%) of the toner is represented by the following Expression 1.

[Math.1]

$$\text{Degree of agglomeration (\%)}=(X+Y+Z)\times 100 \quad (1)$$

An amount of a toner having high flowability remaining on the 200 mesh is small. An amount of the toner having high flowability remaining on the lower meshes is large. A degree of agglomeration is a low value.

(2) Average Circularity of the Toner

The toner in use is preferable a polymerized toner having average circularity equal to or higher than 0.93 rather than a pulverized toner. A measurement method for circularity is explained below.

The circularity of the toner in this embodiment is used as a simple method for quantitatively representing the shape of particles. In this embodiment, a particle shape is measured using a flow particle image analyzer FPIA-1000 manufactured by Sysmex Corporation. Circularity is calculated by the following Expression 2. Further, as indicated by Expression 3, a value obtained by dividing a sum of circularities of all measured particles by a total number of particles is defined as average circularity.

[Math.2]

$$\text{Circularity } (Ci)=\text{Circumferential length of a circle having a projection area same as the number of particles/Circumferential length of a projection image of the number of particles} \quad (2)$$

[Math.3]

$$\text{Average circularity } (C\text{ave})=\Sigma_{i=1}^{m}(C\ i/m) \quad (3)$$

Note that, after calculating the circularities of the particles, in calculating the average circularity, the measuring apparatus "FPIA-1000" used in this embodiment divides the particles into sixty-one divided ranges according to the obtained circularities. For example, the measuring apparatus divides circularities 0.400 to 1.000 into sixty-one divided ranges such as a range of 0.400 or more to less than 0.410, a range of 0.410 or more to less than 0.420, . . . , and a range of 0.990 or more to less than 1.000 at an interval of 0.010. The measuring apparatus calculates the average circularity using a center value and a frequency of division points.

Errors between values of the average circularity calculated by this calculation method and values of the average circularity calculated by the calculation formula directly using the circularities of the particles explained above are extremely small and can be substantially neglected. Therefore, in this embodiment, because of handling of data such as a reduction in a calculation time and simplification of a calculation formula, a calculation method obtained by making use of the concept of the calculation formula, which directly uses the circularities of the particles, and changing a part of the calculation method is used.

The circularity in this embodiment is an index indicating a degree of unevenness of the shape of the particles. When the particles have a perfect spherical shape, the circularity indicates 1.000. As a surface profile becomes more complicated, the circularity is a smaller value. As a specific measuring method for the circularity, about 5 mg of the toner is dispersed in 10 ml of water, in which about 0.1 mg of a nonionic surfactant is dissolved, to prepare dispersion liquid. Ultrasound (20 kHz, 50 W) is irradiated on the dispersion liquid for five minutes. Dispersion liquid concentration is set to 5000 to 20000/μl. A circularity distribution of the particles having a circle-equivalent diameter equal to or larger than 3 μm is measured using the flow particle image analyzer.

An overview of the measurement is described in a catalog of FPIA-1000 issued by Sysmex Corporation (June version, 1995), an operation manual of the measuring apparatus, and Japanese Patent Application Laid-open No. H8-136439. The overview is as explained below.

Sample dispersion liquid is caused to pass through a channel (widening along a flowing direction) of a flat and plane transparent flow cell (having thickness of about 200 mm). To form an optical path passing to cross the thickness of the flow cell, a strobe and a CCD camera are mounted to be located on the opposite sides of each other with respect to the flow cell. While the sample dispersion liquid is flowing, strobe light is irradiated at an interval of 1/30 second in order to obtain images of the particles flowing through the flow cell. As a result, the respective particles are photographed as two-dimensional images having a fixed range parallel to the flow cell. The diameter of a circle having the same area is calculated as a circle-equivalent diameter from the areas of the two-dimensional images of the respective particles. The circularities of the particles are calculated using the circularity calculation formula from projection areas of the two-dimensional images of the respective particles and circumferential lengths of projected images of the particles.

<Configuration Adapted to Paper Powder>

Figure 3A:
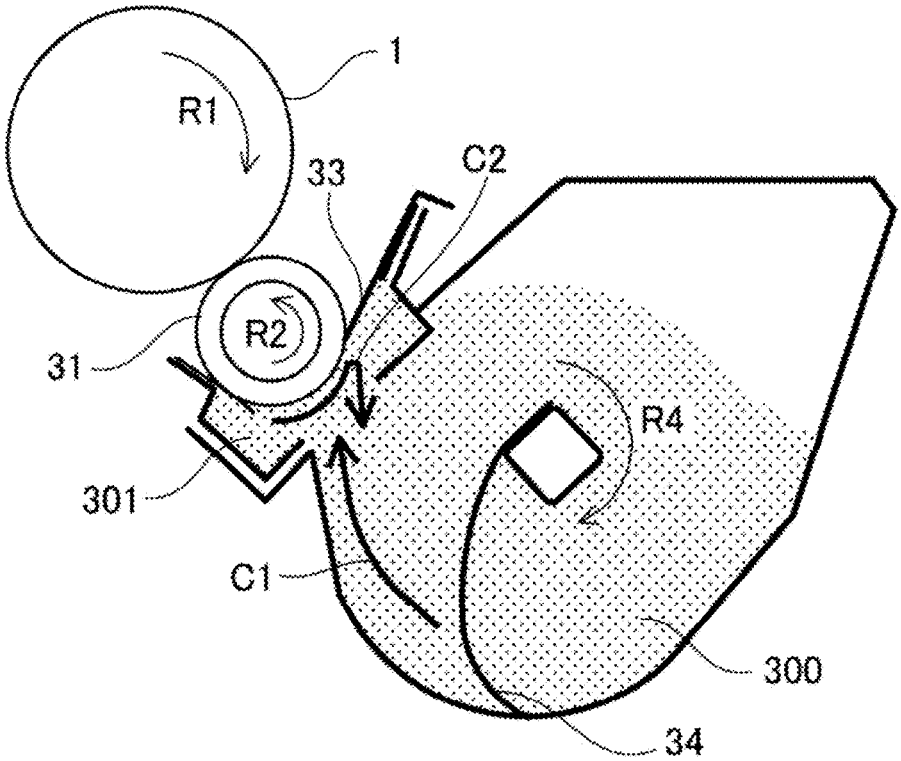
FIG. 3A is a diagram showing the movement of a toner in the developing apparatus in the first embodiment.
Figure 3B:
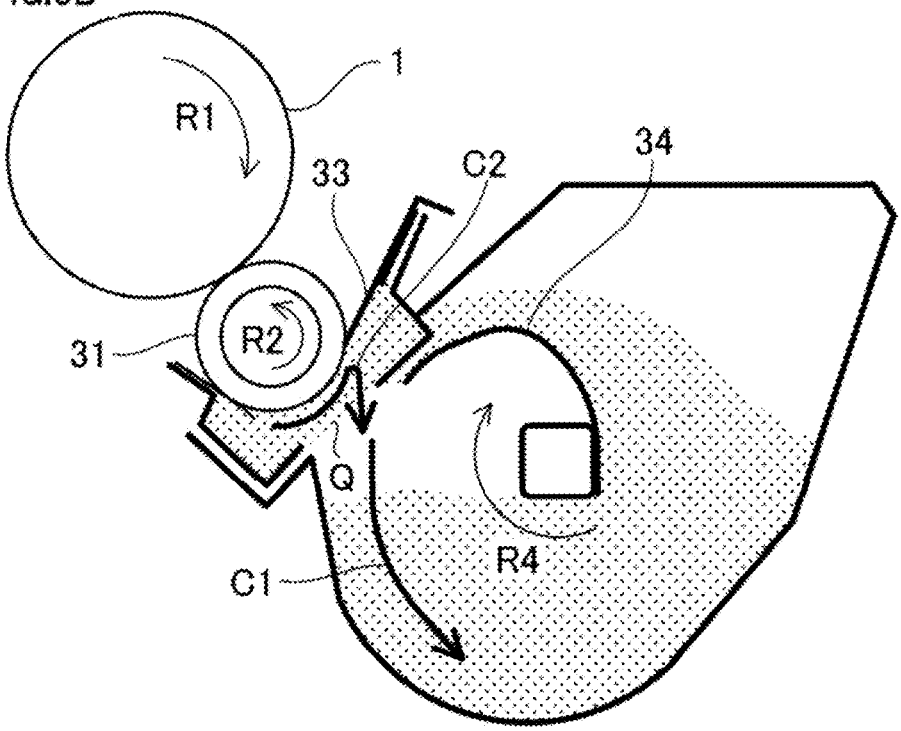
FIG. 3B is a diagram showing the movement of the toner in the developing apparatus in the first embodiment.

A configuration adapted to paper powder, which is a characteristic of the first embodiment, is explained with reference to FIGS. 1, 3A, and 3B. FIGS. 3A and 3B are diagrams showing the movement of the toner in the developing apparatus in the first embodiment. In the developing apparatus 3 according to the first embodiment, the development chamber 301 and the toner storage chamber 300 are connected through an opening Q. The toner in the toner storage chamber 300 is carried to the development chamber 301 through the opening Q by the toner conveying member 34.

As shown in FIG. 1, the developing apparatus 3 is characterized in that a bottom section h of the development chamber 301 is located above a bottom section g of the toner storage chamber 300 in the vertical direction and the regulating section e is located immediately above the opening Q in the vertical direction (located within the opening Q in the relative location in the horizontal direction). Note that FIG. 1 shows the developing apparatus 3 in a mounted state on the image forming apparatus. In FIG. 1, the up-down direction is the vertical direction. A direction perpendicular to the vertical direction is the horizontal direction. A downward direction in the vertical direction is the gravity direction.

As shown in FIG. 1, when viewed in the rotation axis direction of the photosensitive drum 1, a straight line drawn down in the gravity direction from the regulating section e is represented as a straight line B. When viewed in the rotation axis direction of the photosensitive drum 1, a straight line connecting an opening upper end portion X and an opening lower end portion Y is represented as a straight line A. In this embodiment, when viewed in the rotation axis direction of the photosensitive drum 1, an intersection f of the straight line A and the straight line B is present above a horizontal plane passing the opening lower end portion Y. In this embodiment, the rotating direction of the developing sleeve 31 is a direction from the opening lower end portion Y to the opening upper end portion X in a portion where the developing sleeve 31 opposes the opening Q.

The bottom section h of the development chamber 301 is located above the bottom section g of the toner storage chamber 300 in the vertical direction. Note that, as shown in FIG. 1, the bottom section h is a lowermost section in the development chamber 301 in the state in which the developing apparatus 3 is mounted on the image forming apparatus main body. The bottom section g is a lowermost section of the toner storage chamber 300 in the state in which the developing apparatus 3 is mounted on the image forming apparatus main body.

Further, in this embodiment, an axial center i of the toner conveying member 34 in the toner storage chamber 300 is disposed below an axial center j of the developing sleeve in the vertical direction. Therefore, the developing apparatus 3 is a developing apparatus of a toner scooping system that scoops the toner from the toner storage chamber 300 and supplies the toner to the development chamber 301.

When such a configuration is adopted, the toner in the developing apparatus 3 moves as indicated by arrows C1 to C3 in FIGS. 3A and 3B. FIG. 3A shows a state (the arrow C1) in which the toner is fed into the development chamber 301 from the toner storage chamber 300 by the toner conveying member 34. The toner in the development chamber 301 moves as indicated by the arrow C2 according to the rotation of the development sleeve 31.

The toner supplied to the development sleeve 31 by magnetism is carried by the rotation of the developing sleeve 31. An excess of the toner carried to the regulating section e of the development sleeve 31 is scraped off by the regulating blade 33. Such an excess toner is pushed out by the toner fed after the excess toner and forms a flow (the arrow C2) returning to the toner storage chamber 300. In particular, after the distal end of the toner conveying member 34 passes through the opening Q as shown in FIG. 3B, the toner around the regulating blade 33 free-falls in the gravity direction (vertically) and easily returns to the toner storage chamber 300.

Figure 4:
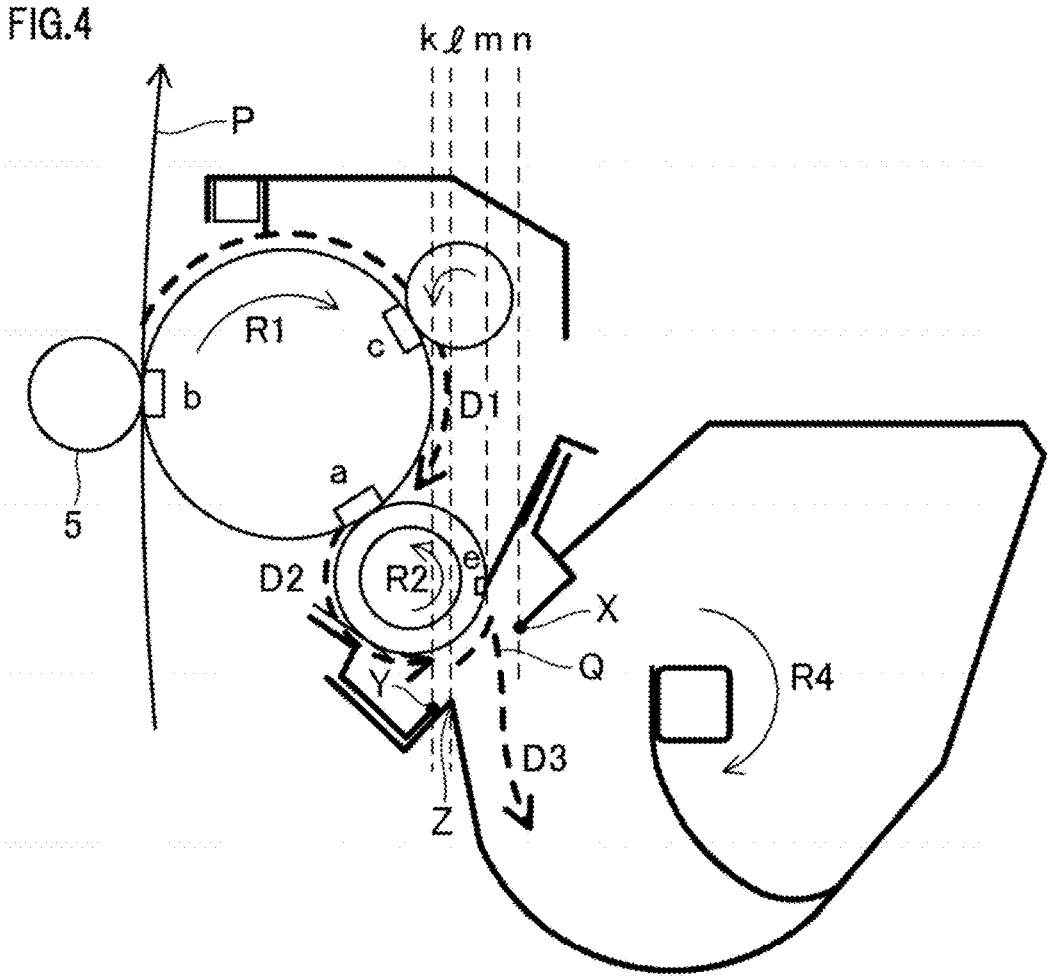
FIG. 4 is a diagram for explaining the movement of paper powder in the first embodiment.

Details concerning the movement of paper powder in the first embodiment are explained with reference to FIG. 4. FIG. 4 is a diagram for explaining the movement of the paper powder in the first embodiment. Broken line arrows D1 to D3 in FIG. 4 show the movements of the paper powder.

The paper powder adhering to the photosensitive drum from the paper P in the transfer section b receives minus electric discharge to change to negative polarity when passing through the charging nip. The paper powder charged in the negative polarity is electrically collected by the developing sleeve 31 in the developing section a (the arrow D1 to the arrow D2).

The paper powder collected by the developing sleeve 31 is mixed with the magnetic toner present in the development chamber 301 and carried to the regulating section e. The magnetic toner is attracted to the developing sleeve 31 by magnetism. However, since the paper powder does not have magnetism, a force of the paper powder adhering to the developing sleeve 31 is small. Therefore, even if the paper powder is carried to the regulating section e, the paper powder is scraped off from the developing sleeve 31 by the regulating blade 33 together with the excess toner.

The paper powder separated from the developing sleeve 31 in the regulating section e is carried from the development chamber 301 to the toner storage chamber 300 present in a lower position by a circulating force of the toner and the gravity (the arrow D3). The paper powder sent to the toner storage chamber 300 is sometimes carried to the development chamber 301 again by the toner conveying member 34 and the like. However, since the scooping type toner supply system is adopted, the paper powder not having magnetism drops in the gravity direction and is not supplied to the developing sleeve 31 unlike the magnetic toner.

As shown in FIG. 4, in the first embodiment, the opening Q connecting the development chamber 301 and the toner storage chamber 300 is disposed right under the regulating section e. Therefore, it is possible to feed the paper powder separated in the regulating section e into the toner storage chamber 300. Therefore, since the paper powder does not continue to be present in the vicinity of the developing sleeve 31, it is possible to suppress a risk that the paper powder is held between the developing sleeve 31 and the regulating blade 33 and passes through the regulating section e.

Note that the opening Q in this embodiment means a space between the opening upper end portion X and the opening lower end portion Y of the first frame body 3A that forms the development chamber 301. In this embodiment, the space between the opening upper end portion X and the opening lower end portion Y (i.e., the opening Q) only has to be present right under the regulating section e. As shown in FIG. 4, a part (a projecting section Z in FIG. 4) of the second frame body 3B configuring the toner storage chamber 300 sometimes projects to cover the opening Q. In the case of such a configuration, a space between the projecting section Z of the second frame body 3B and the opening upper end portion X of the first frame body 3A only has to be present right under the regulating section e. That is, when the opening Q is covered with the second frame body 3B, a dotted line m in FIG. 4 only has to be located between a dotted line 1 and a dotted line n. The regulating section e only has to be present above the projecting section Z in the vertical direction. On the other hand, when the opening Q is not covered with the second frame body 3B, the dotted line m in FIG. 4 only has to be located between a dotted line k and the dotted line n. The regulating section e only has to be present above the opening lower end portion Y in the vertical direction. Note that the dotted lines k, l, m, and n are respectively straight lines in the vertical direction passing the opening lower end portion Y, the projecting section Z, the regulating section e, the opening upper end portion X.

Figure 13:
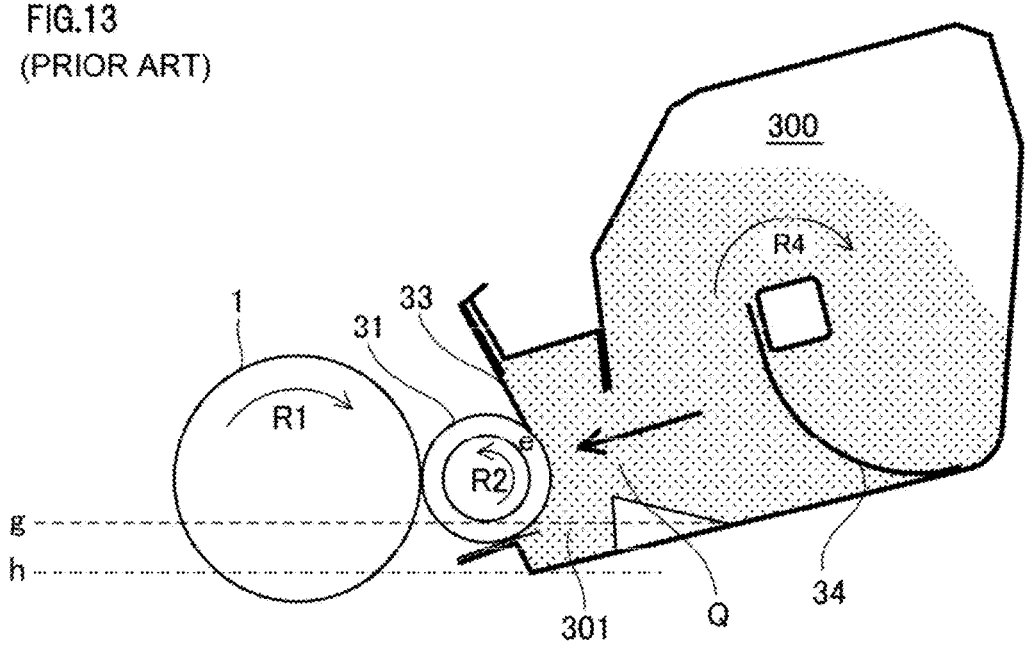
FIG.13 (PRIOR ART)
FIG. 13 is a schematic sectional view showing the configuration of a developing apparatus of a conventional example.

A developing apparatus of a conventional example is shown in FIG. 13. In the developing apparatus of the conventional example, the regulating section e is not located immediately above (above) the opening Q (the regulating section e and the opening Q are out of position in the relative location in the horizontal direction), which connects the development chamber 301 and the toner storage chamber 300, in the vertical direction. The bottom section h of the development chamber 301 is located below the bottom section g of the toner storage chamber 300 in the vertical direction.

Therefore, the paper powder located in a position apart from the developing sleeve 31 continues to be present in the development chamber 301. Therefore, there is a risk that the paper powder is supplied to the developing sleeve 31. The paper powder in the vicinity of the developing sleeve 31 is pressed against the developing sleeve 31 by the pressure of the toner supplied from the toner storage chamber 300. Such paper powder sometimes adheres to the developing sleeve 31, reaches the regulating section e, and is held between the developing sleeve 31 and the regulating blade 33 or passes through the regulating section e.

As explained above, since the positions of the regulating section, the opening, the bottom section of the development chamber, and the storage chamber are in the relation explained above, it is possible to store the paper powder in the storage chamber.

In the following explanation, in relation to this embodiment, concerning a configuration in which the paper powder can be more effectively stored in the storage chamber, an additional configuration is explained.

First, in the first embodiment, as the toner, a toner having a low degree of agglomeration and high spheroidicity is used. This makes it easy to exhibit the effects of the configuration adapted to the paper powder in the developing apparatus shape in this embodiment. Since the toner having the high degree of agglomeration is easily loosened, the paper powder and the toner easily separate from each other. The toner having the high spheroidicity has fewer contacts with the paper powder. An attachment force of the paper powder to the toner decreases. Therefore, the paper powder and the toner easily separate from each other. The toner having the low degree of agglomeration actively circulates between the development chamber 301 and the toner storage chamber 300 because of high flowability. The paper powder is easily carried to the toner storage chamber 300. In this way, by using the toner having the low degree of agglomeration and the high spheroidicity, the effects of the configuration adapted to the paper powder in the first embodiment are easily exhibited.

The low degree of agglomeration of the toner in this embodiment means a degree of agglomeration equal to or lower than 40 in an unused state (or a state before use). Further, the degree of agglomeration is preferably equal to or lower than 55 throughout a period of use before replacement. The toner having the high spheroidicity in this embodiment means a polymerized toner having average circularity equal to or higher than 0.85 and preferably a polymerized toner having average circularity equal to or higher than 0.93.

In this embodiment, the positions of the regulating section, the opening, the bottom section of the development chamber, and the storage chamber only have to satisfy the relation explained above. The characteristics of the toner are additional requirements. Therefore, the toner only has to have the low degree of agglomeration. The toner only has to have the high spheroidicity. It goes without saying that the toner having both the characteristics is more effective.

Figure 5A:
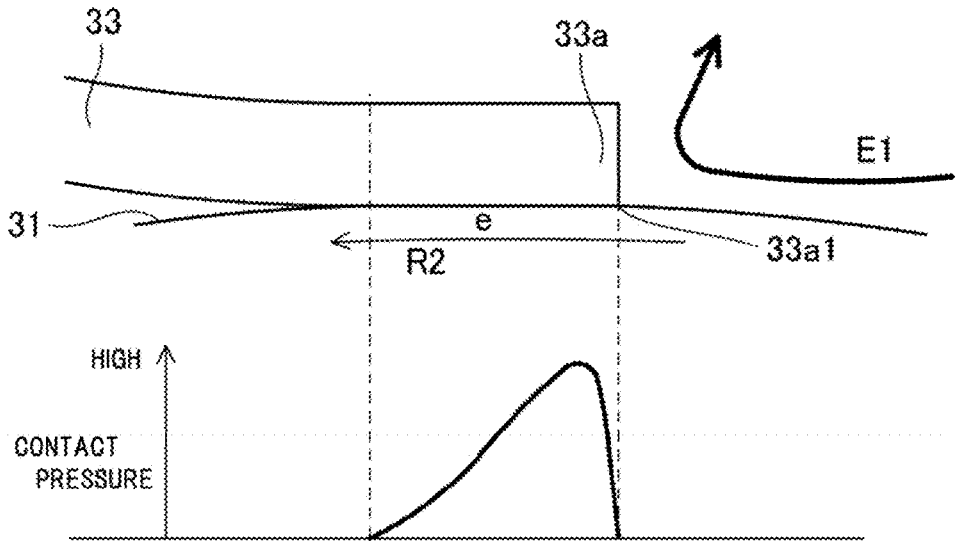
FIG. 5A is a schematic diagram showing a contact state and the distribution of a contact pressure of a regulating blade and a developing sleeve.
Figure 5B:
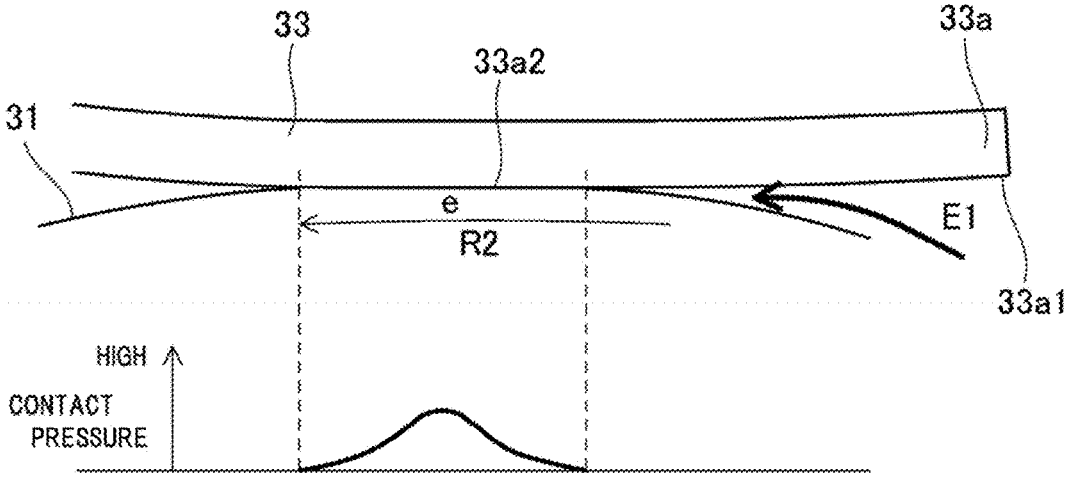
FIG. 5B is a schematic diagram showing a contact state and the distribution of a contact pressure of the regulating blade and the developing sleeve.

Concerning a contact state and a contact pressure of the regulating blade 33 with the developing sleeve 31 in the first embodiment, an additional configuration is explained with reference to FIGS. 5A and 5B. FIG. 5A is a schematic diagram showing a contact state and the distribution of a contact pressure of the regulating blade and the developing sleeve in the first embodiment. FIG. 5B is a schematic diagram showing a contact state and the distribution of a contact pressure of the regulating blade and the developing sleeve in a first modification.

In the first embodiment, as shown in FIG. 5A, an edge 33*a*1 (corner portion) of the distal end portion 33*a* of the regulating blade 33 is in contact with the surface of the developing sleeve 31. On the other hand, in the first modification, as shown in FIG. 5B, a stem portion 33*a*2 of the distal end portion 33*a* of the regulating blade 33 is in contact with the surface of the developing sleeve 31.

An arrow E1 in FIGS. 5A and 5B indicates the movement of the paper powder. In the configuration in the first embodiment, a contact pressure applied to the distal end side of the regulating blade 33 increases. Even if the paper powder reaches the vicinity of the regulating section e, the paper powder is scraped off in an inlet of the regulating section e. On the other hand, in a configuration in the first modification, a contact pressure by the regulating blade 33 is broadly applied. Therefore, the contact pressure is weak in the inlet of the regulating section e. It is likely that the paper powder enters between the regulating blade 33 and the developing sleeve 31.

In this way, by setting the peak of the contact pressure high in the vicinity of the edge 33*a*1 of the distal end portion 33*a* of the regulating blade 33, it is possible to further reduce the toner slipping through or caught between the regulating blade 33 and the developing sleeve 31.

(Second Embodiment)

Figure 6A:
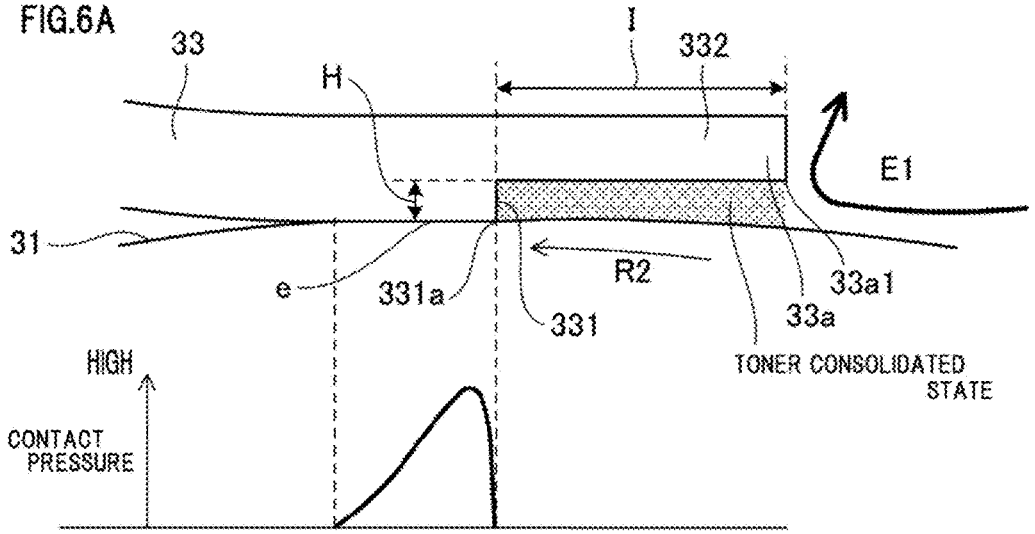
FIG. 6A is a schematic diagram showing a contact state and the distribution of a contact pressure of the regulating blade and the developing sleeve.
Figure 6B:
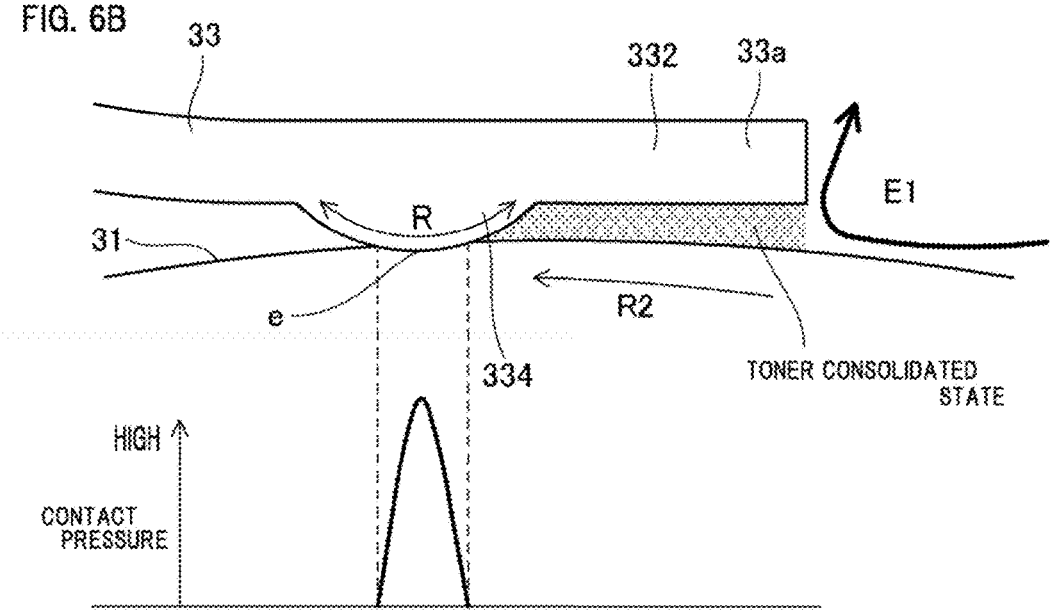
FIG. 6B is a schematic diagram showing a contact state and the distribution of a contact pressure of the regulating blade and the developing sleeve.

A second embodiment is explained with reference to FIGS. 6A and 6B. FIG. 6A is a schematic diagram showing a contact state and the distribution of a contact pressure of the regulating blade and the developing sleeve in the second embodiment. FIG. 6B is a schematic diagram showing a contact state and the distribution of a contact pressure of the regulating blade and the developing sleeve in a second modification of the second embodiment. The configuration of developing assemblies according to the second embodiment and the second modification are the same except that the configurations of the regulating blades are different. Therefore, the same components are denoted by the same reference numerals and signs. Explanation of the components is omitted.

As shown in FIG. 6A, the regulating blade 33 in the second embodiment includes a step portion 331 upstream in the rotating direction of the developing sleeve 31 to have a gap between the distal end portion 33*a* and the developing sleeve 31. The regulating blade 33 includes an eaves portion 332 on the upstream side in the rotating direction of the step portion 331. As shown in FIG. 6B, the regulating blade 33 in the second modification of the second embodiment has a shape including a protruded portion 334 having a curved surface, which is a step portion, and the eaves portion 332. The step portion in this embodiment is located further upstream in the rotating direction than the contact region. Therefore, the step portion is referred to as upstream step portion to be distinguished from a step portion explained below.

By providing this eaves portion 332, large paper powder is removed from the developing sleeve 31 before reaching the regulating section e (an arrow E1 in FIGS. 6A and 6B). Since a gap between the eaves portion 332 and the developing sleeve 31 is narrow, the gap between the eaves portion 332 and the developing sleeve 31 is consolidated. Therefore, since small paper powder is also prevented from entering by the consolidated toner accumulated in the eaves portion 332, the paper powder less easily enters the regulating section e.

In the second embodiment, as shown in FIG. 6A, an edge 331*a* of the step portion 331 of the regulating blade 33 is in contact with the surface of the developing sleeve 31. Therefore, a peak pressure in the regulating section e can be set high. It is possible to reduce the toner slipping through or caught between the developing sleeve 31 and the regulating blade 33.

In the second embodiment, height H of the step portion 331 is set to 300 μm and length l of the eaves portion 332 is set to 1.0 mm. However, the present invention is not limited to this. It is desirable to set the height H of the step portion 331 to 200 to 400 μm and set the length l of the eaves portion 332 to 0.5 to 2.5 mm.

The same effect can be obtained by a shape in the second modification of the second embodiment shown in FIG. 6B. In this shape as well, the height H of the step portion 331 is set to 300 μm, the length I of the eaves portion 332 is set to 1.0 mm, and R of the protruded portion 334 is set to 0.4 mm.

As explained above, by using the regulating blade 33 having the shape of the second embodiment or the second modification of the second embodiment, it is possible to reduce the large paper powder before the large paper powder reaches the regulating section e. Further, it is possible to reduce the influence on an image due to the paper powder caught or slipping through between the developing sleeve 31 and the regulating blade 33.

(Third Embodiment)

<Overview of the Overall Configuration of an Image Forming Apparatus>

Figure 7:
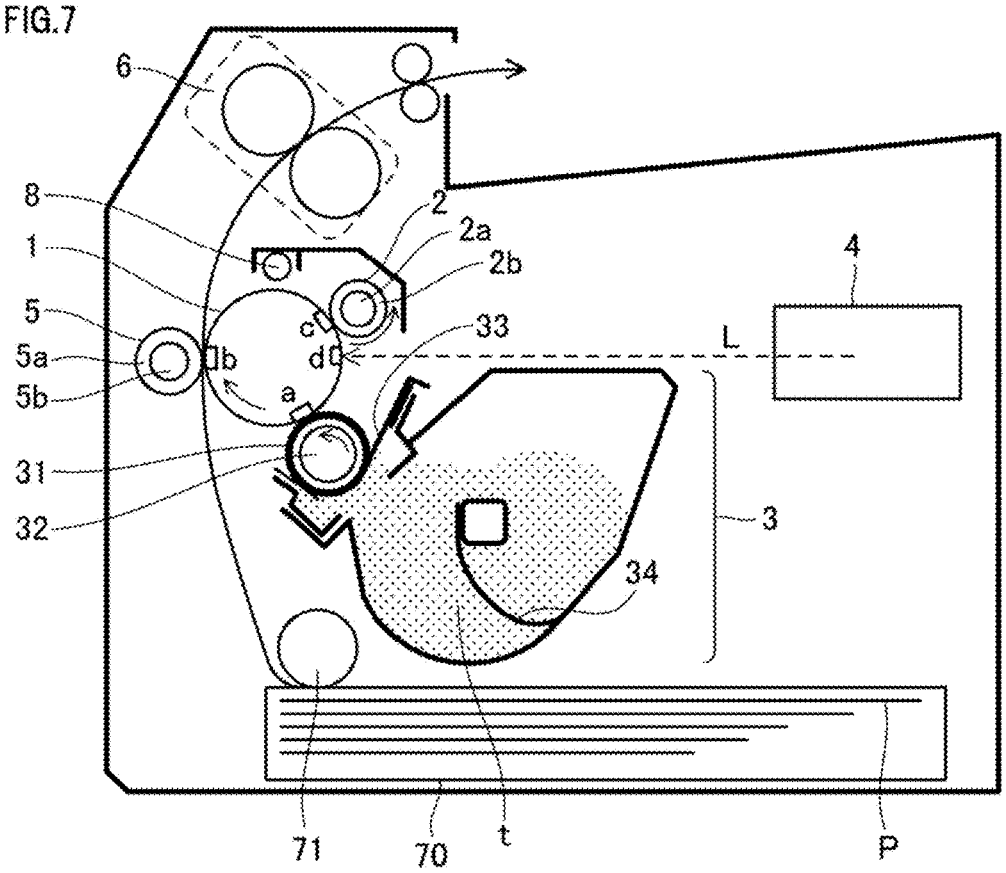
FIG. 7 is a schematic sectional view showing the overall configuration of an image forming apparatus according to a third embodiment.

First, an overview of the entire configuration of an image forming apparatus according to a third embodiment of the present invention is explained with reference to FIG. 7. FIG. 7 is a schematic sectional view showing the overall configuration of the image forming apparatus according to the third embodiment of the present invention. In this embodiment, as the image forming apparatus, a monochrome laser printer employing a transfer electrophotographic process is used. Note that matters not particularly explained here are the same as the matters explained in the first and second embodiments. In the third embodiment, components common to the first and second embodiments are denoted by reference numerals and signs same as the reference numerals and signs in the first and second embodiment. Explanation of the components is omitted.

The photosensitive drum 1 in this embodiment is an OPC photosensitive body having a diameter of φ20 mm and negative polarity. The photosensitive drum 1 is provided to be rotatable in the arrow R1 direction in the figure at circumferential speed (process speed or printing speed) of 150 mm/sec. The diameter of the photosensitive drum 1 is set smaller than the photosensitive drum 1 of the image forming apparatus in the first embodiment. The image forming apparatus in the third embodiment is different from the image forming apparatus in the first embodiment in that the position of the optical discharging member 8 is located immediately above the vertex of the photosensitive drum 1 and located further on the contact charging member side than the optical discharging member 8 in the first embodiment.

<Measures Against the Charging Roller>

In this embodiment, two configurations explained below are adopted in order to cause an untransferred toner to pass through the charging nip without adhering to the changing roller 2.

Figure 8:
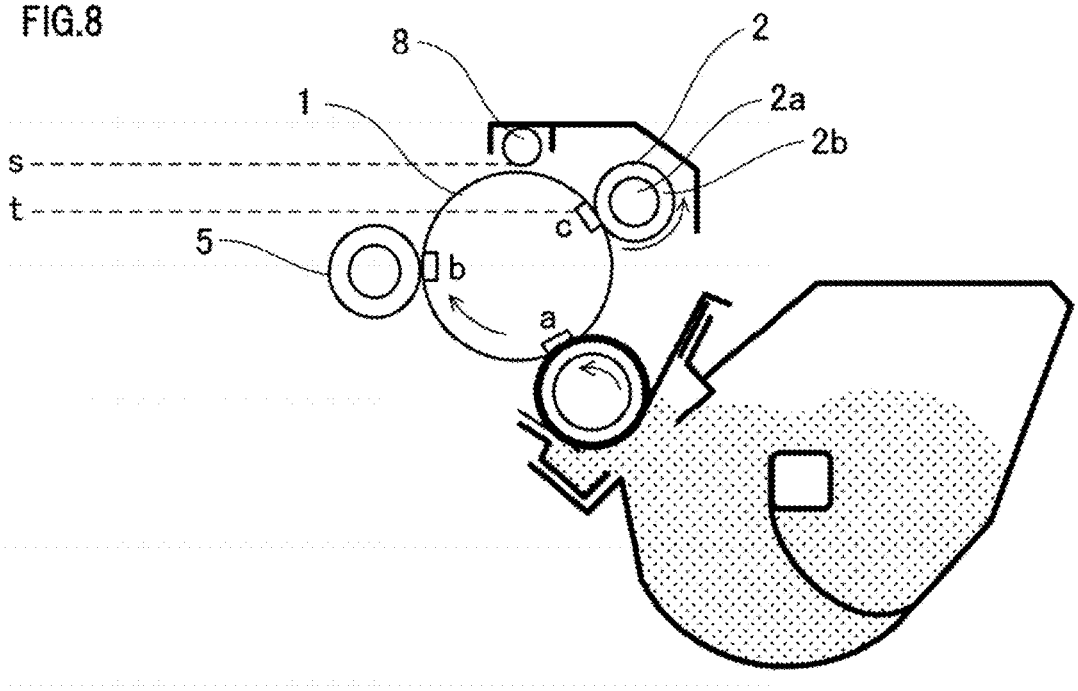
FIG. 8 is a schematic sectional view showing the configuration of a charging roller and an optical discharging member according to the third embodiment.

First, as shown in FIG. 8, the optical discharging member 8 is provided between the transfer roller 5 and the charging roller 2 in the rotating direction of the photosensitive drum 1. In order to perform stable electric discharge in the charging nip, the optical discharging member optically discharges the surface potential of the photosensitive drum 1 after the untransferred toner passes through the transfer nip. The potential of the photosensitive drum 1 before charging is set to about −150 V in an entire longitudinal region by the optical discharging member 8. This makes it possible to perform uniform electric discharge during the charging and uniformly charge the untransferred toner in negative polarity. As a result, the untransferred toner passes through the charging nip.

Second, the charging roller 2 is driven to rotate with a predetermined circumferential speed difference provided between the charging roller 2 and the photosensitive drum 1. Although most of the toner is charged in negative polarity by the electric discharge as explained above, the toner not charged in the negative polarity slightly remains. The toner sometimes adheres to the charging roller 2 in the charging nip. Therefore, by driving to rotate the charging roller 2 and the photosensitive drum 1 with the predetermined circumferential speed difference provided therebetween, it is possible to charge such a toner in the negative polarity with rubbing of the photosensitive drum 1 and the charging roller 2. Consequently, there is an effect of suppressing the adhesion of the toner to the charging roller 2.

The configurations of the optical discharging member and the charging roller related to the configuration for reducing the toner adhesion to the charging roller are explained.

<Optical Discharging Member>

Figure 9:
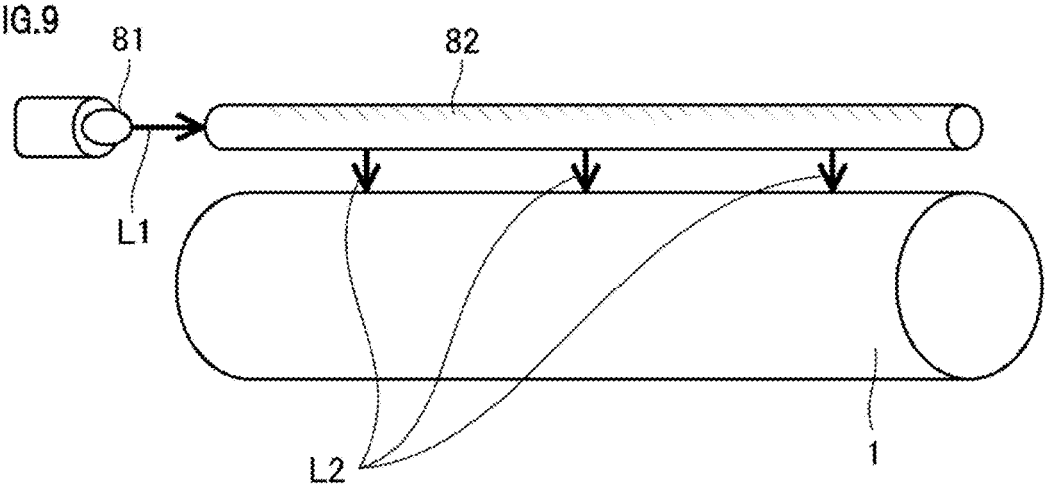
FIG. 9 is a schematic diagram showing the configuration of the optical discharging member according to the third embodiment.

FIG. 9 is a schematic diagram showing the schematic configuration of the optical discharging member 8 in the third embodiment. As shown in FIG. 9, the optical discharging member 8 has a configuration in which an LED 81 disposed in an image forming apparatus main body emits light from a photosensitive drum longitudinal end portion and the emitted light is irradiated on an entire longitudinal region of the photosensitive drum 1 through a light pipe 82 disposed to be opposed to the photosensitive drum 1 in the longitudinal direction. By adopting this configuration, it is possible to reduce fluctuation in an irradiated light amount over the longitudinal direction of the photosensitive drum 1. Another type of the optical discharging member 8 may be an LED array in which a plurality of LEDs are arrayed in the longitudinal direction of the photosensitive drum 1.

<Charging Roller (Contact Charging Member)>

The charging roller 2 includes the cored bar 2*a* having a diameter of φ6 mm, the conductive elastic layer 2*b* that covers the cored bar 2*a*, and a surface layer that covers the surface of the conductive elastic layer 2*b*. The outer diameter of a portion including the conductive elastic layer 2*b* and the surface layer is about φ10 mm. The charging roller 2 is pressed against the photosensitive drum 1 by a spring at pressure of about 400 g on one side. Consequently, the charging roller 2 and the photosensitive drum 1 form a predetermined nip. In this embodiment, a charging roller gear is provided in the cored bar 2*a* of the charging roller 2. The charging roller gear engages with a drum gear provided at a photosensitive drum end portion. Therefore, as the photosensitive drum 1 is driven to rotate, the charging roller 2 is also driven to rotate. In a contact region (a contact section) of the surface of the charging roller 2 and the surface of the photosensitive drum 1, the respective surfaces move in the same direction (forward direction driving). The circumferential speed of the surface (the moving speed of the surface) of the charging roller 2 is set to be 15% higher than the circumferential speed of the surface of the photosensitive drum 1.

<Positional Relationship Between the Charging Roller and the Optical Discharging Member>

In recent years, according to a reduction in the size of the image forming apparatus, the size of the photosensitive drum 1 is reduced. The distance between the charging roller 2 and the optical discharging member 8 is reduced. Therefore, it is likely that the toner and the paper powder rushed into the charging nip scatter with the driving of the charging roller 2 and stain the optical discharging member 8. In particular, it is likely that the portion of the light pipe 82 is stained.

In this embodiment, in order to cope with the problem, the optical discharging member 8 is disposed above the charging section c, which forms the charging nip, in the gravity direction. That is, the position of the charging section c, which is a contact region on the photosensitive drum 1 side of a portion of the charging roller 2 in contact with the photosensitive drum 1 (a portion of the photosensitive drum 1 in contact with the charging roller 2), is located below the optical discharging member 8 in the vertical direction. Consequently, the toner and the paper powder scattering with the driving of the charging roller 2 basically drop in the gravity direction. Therefore, by disposing the optical discharging member 8 above the charging section c, it is possible to reduce the toner and the paper powder that scatter and drop to stain the optical discharging member 8.

Further, as explained above, the driving direction of the charging roller 2 is set in the forward direction with respect to the surface of the photosensitive drum 1 and the circumferential speed of the charging roller 2 is set higher than the circumferential speed of the photosensitive drum 1. By adopting such a configuration, the toner and the paper powder on the photosensitive drum 1 are pushed out to the rotating direction downstream side of the photosensitive drum (or the rotating direction downstream side of the charging roller 2) by the charging roller 2. Therefore, the toner and the paper powder are less easily scraped off in the charging nip. Even if the charging roller 2 scrapes off the toner and the paper powder on the photosensitive drum 1, a scattering direction of the toner and the paper powder is a direction to a side (the rotating direction upstream side) opposite to the rotating direction downstream side where the optical discharging member 8 is disposed. Therefore, the toner and the paper powder scattering toward the optical discharging member 8 is reduced.

(Fourth Embodiment)

Figure 10:
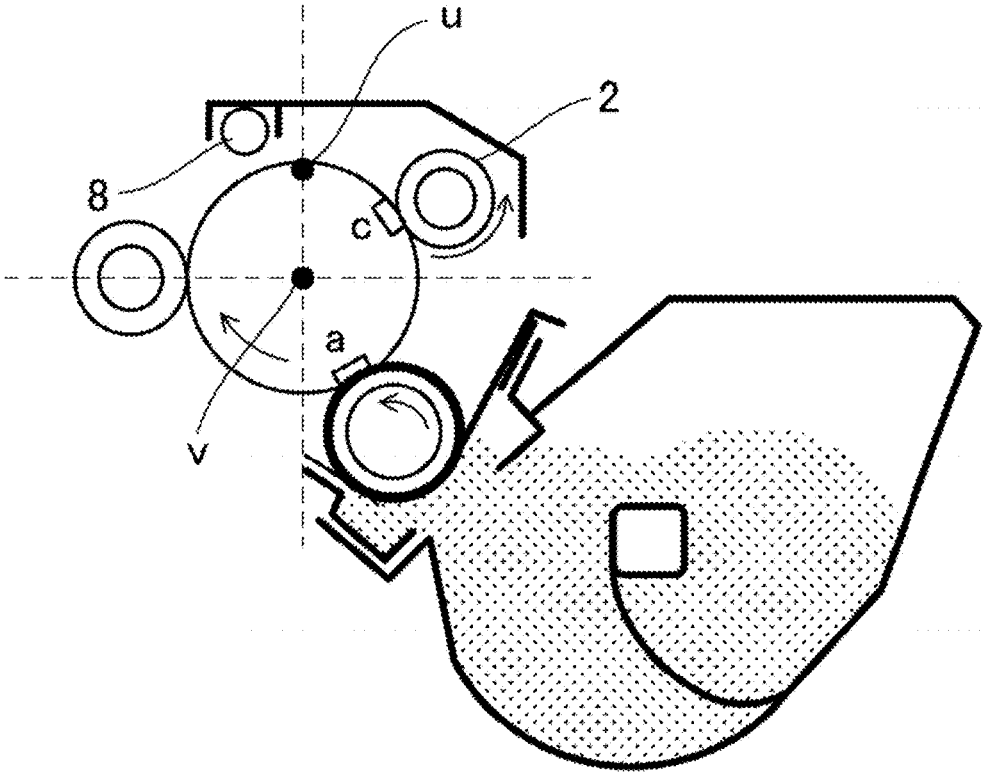
FIG. 10 is a schematic sectional view showing the configuration of a charging roller and an optical discharging member according to the fourth embodiment.

The disposition of the charging roller and the optical discharging member, which is a characteristic of a fourth embodiment of the present invention, is shown in FIG. 10. Components other than the disposition of the charging roller and the optical discharging member are the same as the components in the third embodiment. Explanation of the components is omitted.

In this embodiment, as shown in FIG. 10, the charging roller 2 and the optical discharging member 8 are respectively disposed on opposite sides across a straight line connecting a vertex u and a center v of the photosensitive drum 1. Consequently, as shown in FIGS. 7 and 8, the toner and the paper powder scattering in the charging nip and adhering to the optical discharging member 8 are reduced from the toner and the paper powder adhering to the optical discharging member 8 when the optical discharging member 8 is located at the vertex of the photosensitive drum 1. Since the vertex u of the photosensitive drum 1 is present between the charging roller 2 and the optical discharging member 8, the scattering toner and paper power less easily reach the optical discharging member 8 side. As explained above, the scattering toner and paper powder basically drop straight. Therefore, only an extremely small amount of the toner and the paper powder move beyond the vertex portion of the photosensitive drum 1. Therefore, the toner and the paper powder do not stain the optical discharging member 8 to such a degree as to substantially reduce an amount of light.

Figure 11A:
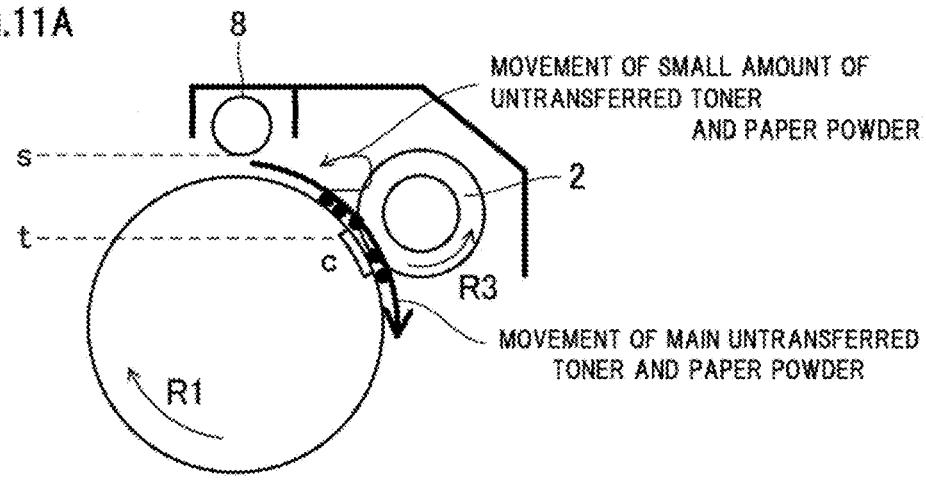
FIG. 11A is a schematic sectional view showing a configuration in the third embodiment.
Figure 11B:
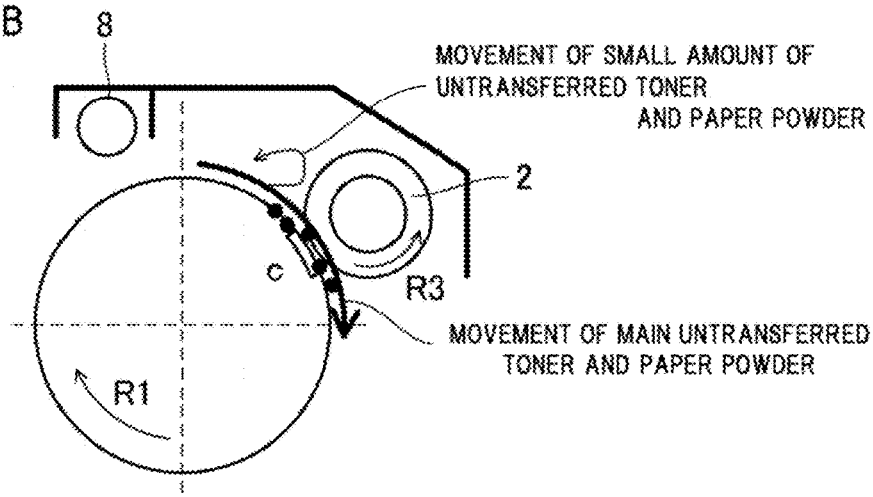
FIG. 11B is a schematic sectional view showing a configuration in the fourth embodiment.
Figure 11C:
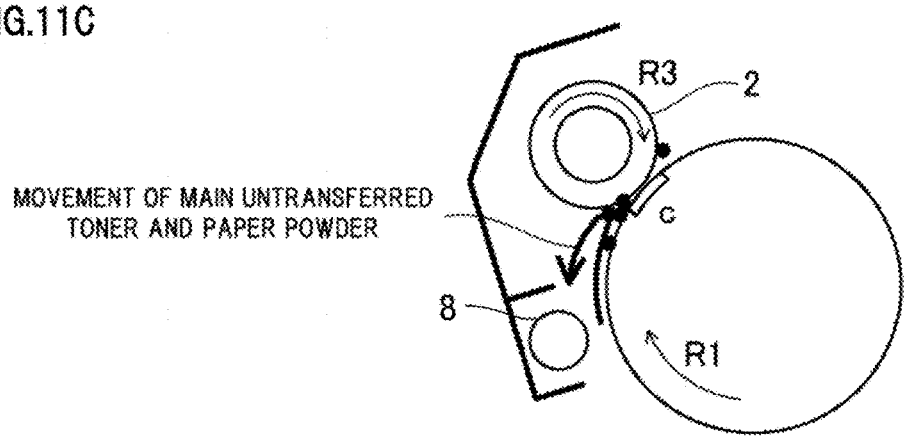
FIG. 11C is a schematic sectional view showing a configuration in a comparative example.

The movement of the untransferred toner and the paper power is explained with reference to FIGS. 11A to 11C. FIG. 11A shows the third embodiment, FIG. 11B shows the fourth embodiment, and FIG. 11C shows a comparative example. In the comparative example, the optical discharging member 8 is provided below the charging roller 2. The surface of the charging roller 2 is driven to move in a direction opposite to the moving direction of the surface of the photosensitive drum 1.

Arrows in the figures indicate the movement of the untransferred toner and the paper powder. In FIGS. 11A and 11B, since the charging roller 2 is driven to rotate in the forward direction, most of the toner and the paper powder pass through the charging nip. The toner and the paper powder sometimes scatter in the charging nip more or less. However, the toner and the paper powder land on the photosensitive drum 1 again without reaching the optical discharging member 8. On the other hand, in the configuration in the comparative example shown in FIG. 11C, the toner and the paper powder scraped off in the charging nip drop and adhere to the optical discharging member 8. Therefore, it is likely that the optical discharging member 8 cannot irradiate discharging light with a sufficient light amount because of stain.

As explained above, by adopting the disposition and the configuration of the charging roller 2 and the optical discharging member 8 explained in the third and fourth embodiments, it is possible to reduce the staining of the optical discharging member 8 by the paper powder and the toner. Further, by adopting such a configuration, it is possible to reduce the distance between the charging roller 2 and the optical discharging member 8. It is possible to contribute to a reduction in the sizes of the image forming apparatus and a cartridge used in the image forming apparatus.

In the third and fourth embodiments, the image forming apparatus is a monochrome image forming apparatus adopting a contact development in which a magnetic toner is used. However, the image forming apparatus is not limited to this and may be a full-color image forming apparatus employing a contact development system in which a nonmagnetic toner and a toner supply roller are used. In the image forming apparatus according to the embodiments, the integrated process cartridge including the photosensitive drum 1, the charging roller 2, the developing apparatus 3, and the optical discharging member 8 is detachably attached to the apparatus main body. However, the configuration of the cartridge is not limited to this. For example, an integrated cartridge including the charging roller 2 and the optical discharging member 8 excluding the photosensitive drum 1 and the developing apparatus 3 may be detachably attached to the apparatus main body. The image forming apparatus may adopt a configuration like a drum unit (a drum device) in which the charging roller 2, the optical discharging member 8, and the photosensitive drum 1 are integrated.

(Fifth Embodiment)

Figure 12A:
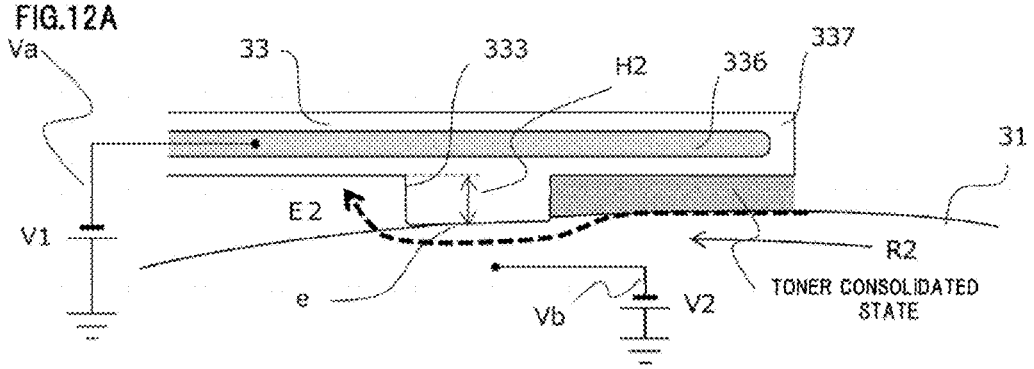
FIG. 12A is a schematic diagram showing a contact state and the distribution of a contact pressure of a regulating blade and a developing sleeve.
Figure 12B:
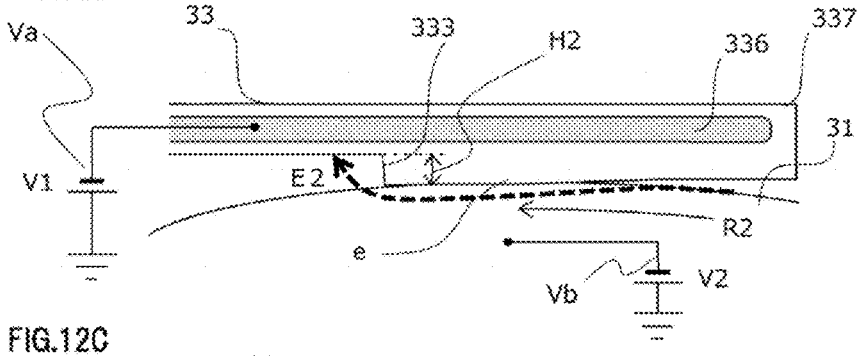
FIG. 12B is a schematic diagram showing a contact state and the distribution of a contact pressure of the regulating blade and the developing sleeve.
Figure 12C:
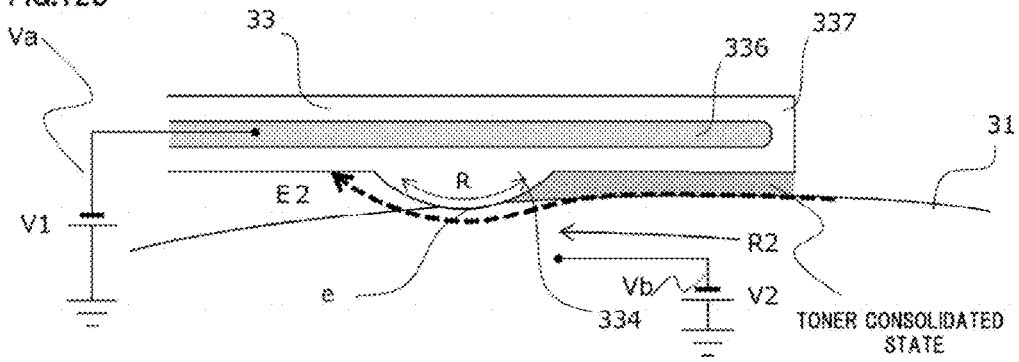
FIG. 12C is a schematic diagram showing a contact state and the distribution of a contact pressure of the regulating blade and the developing sleeve.
Figure 12D:
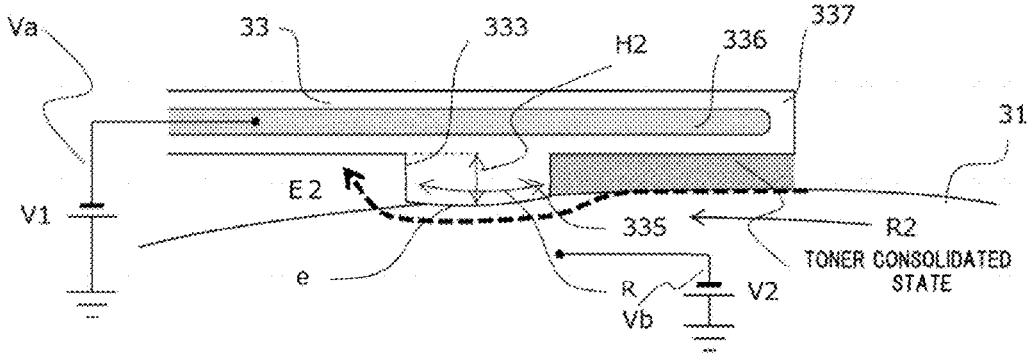
FIG. 12D is a schematic diagram showing a contact state and the distribution of a contact pressure of the regulating blade and the developing sleeve.

A fifth embodiment is explained with reference to FIGS. 12A to 12D. FIGS. 12A to 12D are schematic diagrams showing a contact state and a contact pressure of the regulating blade and the developing sleeve in the fifth embodiment. More specifically, FIG. 12A shows the fifth embodiment, FIG. 12B shows a third modification of the fifth embodiment, FIG. 12C shows a fourth modification of the fifth embodiment, and FIG. 12D shows a fifth modification of the fifth embodiment. These figures are schematic sectional views showing states around the contact region of the regulating blade 33 and the developing sleeve 31 in respective configurations of the fifth embodiment, the third modification, the fourth modification, and the fifth modification. Cross sections shown in the schematic sectional views are cross sections perpendicular to the longitudinal direction of the regulating blade 33 (the axis of the developing sleeve 31). Note that, since the configuration of the image forming apparatus in the fifth embodiment is substantially the same as the configuration in the first embodiment, the same components are denoted by the same reference numerals and signs. Explanation of the components is omitted. Characteristics of this embodiment are application of blade bias to the regulating blade 33 and the shape of the regulating blade 33.

<Blade Bias>

In this embodiment, for the purpose of application of appropriate electric charges to the toner, in order to provide a potential difference between the regulating blade 33 and the developing sleeve 31, blade bias on the same polarity side as the toner with respect to developing bias is applied to the regulating blade 33. In this embodiment, a voltage of −350 V is applied to the developing sleeve 31 from voltage applying means Vb (a developing bias application power supply) as a voltage V2 (developing bias). In this embodiment, a voltage of −650 V is applied to the regulating blade 33 from voltage applying means Va (a blade bias application power supply) as a voltage V1 (blade bias) such that the regulating blade 33 has a potential difference of −300 V with respect to the developing sleeve 31. That is, the blade bias is applied at magnitude (−650 V) that is larger than the developing bias (−350 V) on the same polarity side as the toner to set a potential difference between the developing sleeve 31 and the regulating blade 33 to a potential difference (−300) of magnitude on the same polarity (minus) side as the toner. However, when only measures against the paper powder are considered, bias does not have to be applied.

<Regulating Blade>

In this embodiment, as the regulating blade 33, a regulating blade obtained by covering a SUS plate 336 having thickness of about 80 μm with conductive resin 337 (a conductive member) having thickness of about 100 μm is used. In the regulating blade 33, a step portion 333 having height H2 of 300 μm is provided such that the regulating blade 33 has a gap between the regulating blade 33 and the developing sleeve 31 on the downstream side of the regulating section e, which is the contact section in contact with the developing sleeve 31.

<Movement of the Paper Powder>

An arrow E2 shown in FIG. 12A indicates the movement of the paper powder. The paper powder collected into a developing device is sometimes born on the surface of the developing sleeve 31 together with the toner by a conveying force due to surface roughness of the developing sleeve 31 and carried to the regulating section e between the regulating blade 33 and the developing sleeve 31. The layer thickness of the toner and the paper powder carried to the regulating section e is regulated by the regulating blade 33. Electric charges are applied to the toner and the paper powder by triboelectric charging due to rubbing between the developing sleeve 31 and the regulating blade 33. In that case, the paper powder tends to be charged in positive polarity because of charging series of the toner and the paper powder with respect to the toner having negative charging performance used in the fifth embodiment. In the configuration in which the potential difference is provided between the regulating blade 33 and the developing sleeve 31 by the blade bias, the paper powder passed through the regulating section e and charged in positive polarity is attracted to the regulating blade 33 downstream of the regulating section e because of the potential difference between the regulating blade 33 and the developing sleeve 31. In the regulating blade 33, the downstream step portion 333 is provided downstream of the regulating section e. Therefore, the paper powder attracted to the regulating blade 33 is accumulated in a space (a gap) formed between the regulating blade 33 and the developing sleeve 31 on the downstream side of the regulating section e by the step portion 333. Even if the paper powder increases according to paper feeding, the paper powder can be accumulated by the downstream step portion 333. Therefore, it is possible to reduce occurrence of an image failure due to disturbance of the coat on the developing sleeve 31.

When the step height H2 of the step portion 333 is small, the paper powder cannot be sufficiently accumulated. On the other hand, when the step height H2 is large, the paper powder is less easily attracted to the regulating blade 33. Therefore, in this embodiment, the potential difference between the regulating blade 33 and the developing sleeve 31 is set to −300 V and the height H2 of the step portion 333 is set to 300 μm. However, when the potential difference is −300 V, it is desirable to set the step height H2 to 100 to 500 μm.

In a configuration different from the configuration explained above, it is possible to obtain the same effect by appropriately selecting a range of the step height H2. It is also desirable to set the blade bias to have a potential difference of −100 V to −600 V between the regulating blade 33 and the developing sleeve 31 from the viewpoint of application of appropriate electric charges to the toner.

The same effect can be obtained in a shape of the third modification of the fifth embodiment shown in FIG. 12B. This modification has a configuration in which the conductive resin 337 on a side of the surface of the regulating blade 33 opposed to the developing sleeve 31 is formed thicker on the upstream side (the distal end side) of the regulating section e than on the downstream side of the regulating section e in a cross section perpendicular to the longitudinal direction of the regulating blade 33. In such a configuration as well, the paper powder passed through the regulating section e is trapped in a space downstream of the regulating section e formed by the step portion 333. The step height H2 of the step portion 333 is set to 300 μm in the cross sectional shape.

The same effect can be obtained in a shape of the fourth modification of the fifth embodiment shown in FIG. 12C. This modification has a configuration in which the regulating blade 33 includes the protruded portion 334 entirely having an arcuate contour in the cross section perpendicular to the longitudinal direction of the regulating blade 33. In the protruded portion 334, in the cross sectional shape, the step height (height from the surface of the regulating blade 33 opposed to the developing sleeve 31 to the top portion of the arcuate portion) H2 is set to 300 μm and R of the protruded portion 334 is set to 0.4 mm.

The same effect can be obtained in a shape of the fifth modification of the fifth embodiment shown in FIG. 12D. This modification has a configuration in which the regulating blade 33 includes a protruded portion 335, a distal end face of which having a shape entirely projecting in a substantially rectangular shape is formed in an arcuate contour of a protruded shape in the cross section perpendicular to the longitudinal direction of the regulating blade 33. In the protruded portion 335, in the cross sectional shape, the step height (height from the surface of the regulating blade 33 opposed to the developing sleeve 31 to the top portion of the arcuate distal end face) H2 is set to 300 μm and R of the arcuate contour of the distal end of the protruded portion 335 is set to 1.2 mm.

According to the fifth embodiment and the modifications, it is possible to reduce disordering of the toner on the developing sleeve 31 by the deposited paper powder. Consequently, it is possible to reduce occurrence of an image failure due to the disturbance of the toner on the developing sleeve 31 by the deposited paper powder.

In the fifth embodiment, the step portion is provided on the rotating direction downstream side of the photosensitive drum. However, the configuration in which the step portion is provided on the rotating direction upstream side may be simultaneously provided. In this case, it is possible to more effectively remove the paper powder.

In the fifth embodiment, concerning the posture of the developing apparatus, as in the first embodiment, the bottom section h of the development chamber 301 is located above the bottom section g of the toner storage chamber 300 in the vertical direction and the regulating section e is located immediately above the opening Q in the vertical direction. However, the effect by the configuration in the fifth embodiment can be exhibited the same even when the posture of the developing apparatus is different from the posture in the first embodiment.

Concerning the developer, the magnetic toner is used as in the first embodiment. When the magnetic toner is used, the toner on the developing sleeve is attracted to a magnet roller on the inner side of the developing sleeve. This is advantageous when the toner and the paper powder are separated downstream of the regulating section e. However, when a nonmagnetic developer is used, since the paper powder electrically attracted to the regulating blade is accumulated in the step portion of the regulating blade, the effect in this embodiment of suppressing occurrence of an image failure due to disturbance of the toner on the developing sleeve by the deposited paper powder is the same. Therefore, the same effect is obtained when the nonmagnetic developer is used.

(Sixth Embodiment)

A sixth embodiment is explained with reference to FIGS. 14, 15A, 15B, 16A and 16B. A developing apparatus according to the sixth embodiment is characterized by the location and configuration of the magnet roller 32 and the positional relationship between the magnet roller 32 and the toner storage chamber 300. In the sixth embodiment, components common to above embodiments are denoted by reference numerals and signs same as the reference numerals and signs in the above embodiments. Explanation of the components is omitted.

Figure 14:
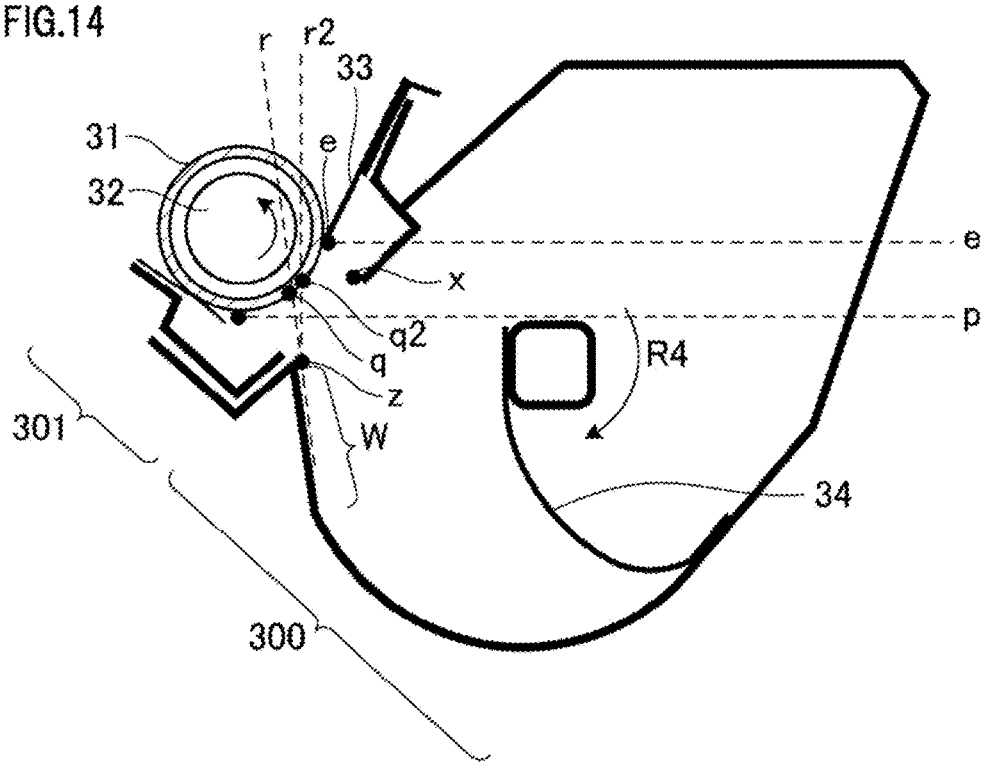
FIG. 14 is schematic sectional view showing the characteristic developing apparatus of the sixth embodiment.

FIG. 14 is schematic sectional view showing the characteristic developing apparatus of the sixth embodiments. A line extending toward the developing sleeve 31 from the inner wall surface of the toner storage chamber 300 including the opening lower end portion Z on the toner storage chamber 300 side is represented as an elongation line r. That is, the developing apparatus 3 of the sixth embodiment is formed with a wall surface region W on the inner wall surface of the toner storage chamber 300. The wall surface region W is located below the opening Q in the vertical direction and connected with the opening lower end portion Z and extends in a direction crossing the developing sleeve 31. A virtual line (or virtual surface) extending in the direction crossing the developing sleeve 31 from the opening lower end portion Z along the surface of the wall surface region W is represented as the elongation line r (or an elongation plane r.) Further, an intersection (or intersection line) of the elongation line r and surface of the developing sleeve 31 is represented as an intersection q (or intersection line q.) The intersection q is set to be located between the regulating section e and a lowest point p of the developing sleeve 31 in the gravity direction (lower end portion of the surface of the developing sleeve 31 in the vertical direction.) A virtual line (or virtual surface) extending in the direction crossing the developing sleeve 31 from the opening lower end portion Z along the vertical direction is represented as the elongation line r2 (or an elongation plane r2.) Further, an intersection (or intersection line) of the elongation line r2 and surface of the developing sleeve 31 is represented as an intersection q2 (or intersection line q2.) The intersection q2 is set to be located between the regulating section e and a lowest point p of the developing sleeve 31 in the gravity direction.

Figure 15A:
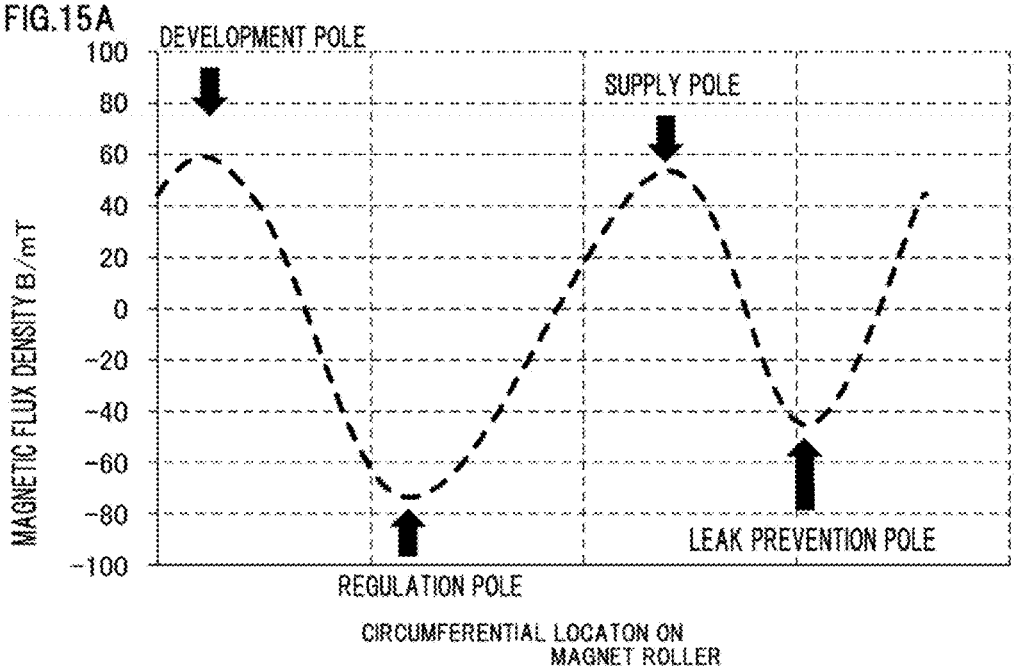
FIG. 15A is a schematic diagram showing a disposition of magnetic poles of the magnetic force generating means of the sixth embodiment.
Figure 15B:
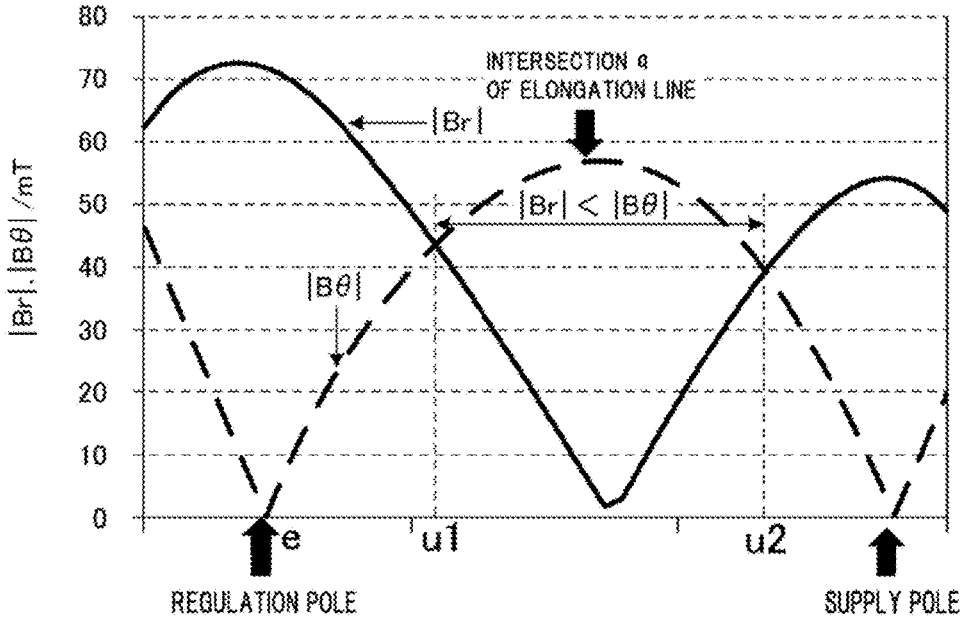
FIG. 15B is a schematic diagram showing a magnetic flux density on the surface of the developing sleeve.
Figure 16A:
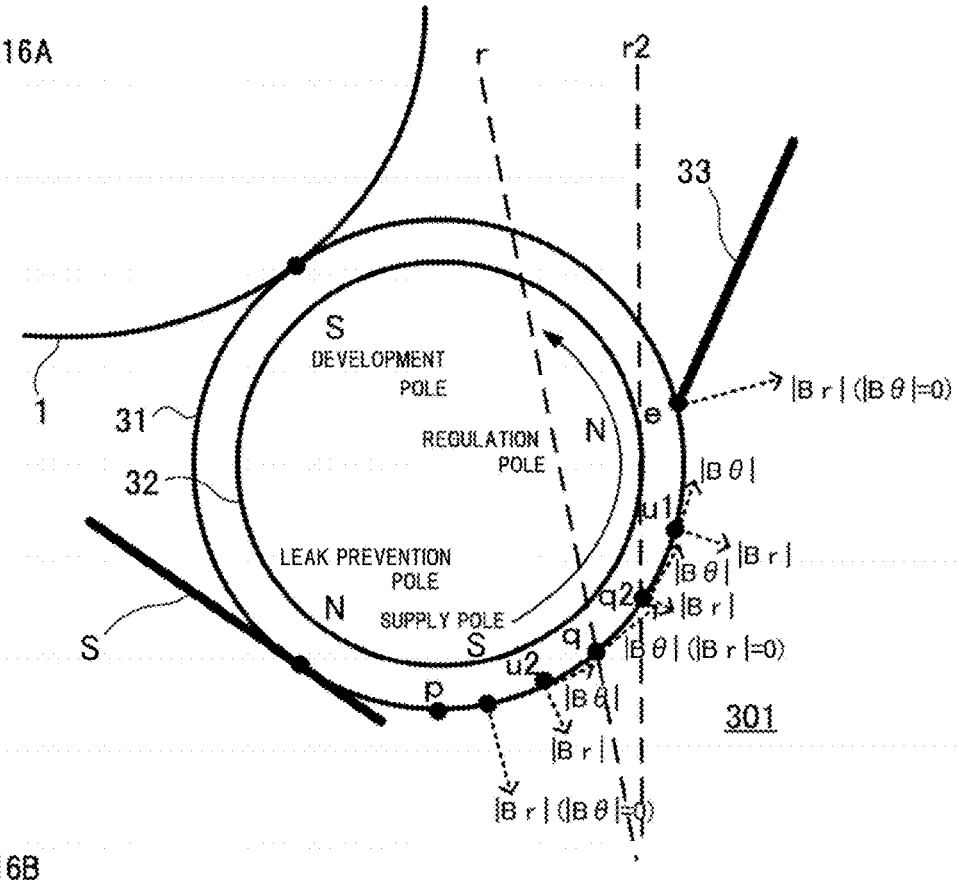
FIG. 16A is a schematic diagram showing the relationship among $|Br|$, $|B\Theta|$ and magnetic poles in FIGS. 15A and 15B plotted on the sectional configuration of the developing apparatus according to the sixth embodiment.
Figure 16B:
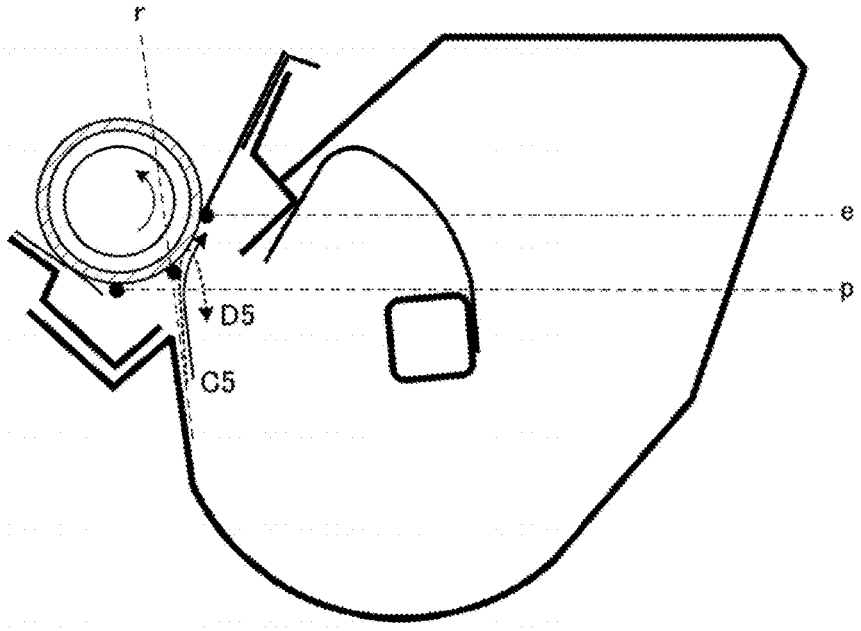
FIG. 16B is a schematic diagram showing the movement of the toner and paper powder in the developing apparatus according to the sixth embodiment.

FIG. 15A is a schematic diagram showing a disposition of magnetic poles of the magnet roller 32 (magnetic force generating means) of the sixth embodiment. FIG. 15B is a schematic diagram showing a relation between a vertical component |Br| and a horizontal component |BΘ| of a magnetic flux density B on the surface of the developing sleeve 31 in a range between the vicinity of the regulation pole to the vicinity of the supply pole in the circumference direction of the magnet roller 32. In FIG. 15B, abscissa axis represents the position of the developing sleeve 31 in the circumference direction and ordinate axis represents the absolute value of the magnetic flux density (mT). Br and BΘ are explained in detail below. FIG. 16A is a schematic diagram showing the relationship among |Br|, |BΘ| and magnetic poles in FIGS. 15A and 15B plotted on the sectional configuration of the developing apparatus according to the sixth embodiment. FIG. 16B is a schematic diagram showing the movement of the toner and paper powder in the developing apparatus according to the sixth embodiment.

In the sixth embodiment, the magnetic flux density is measured using a series 9900 of gaussmeter manufactured by F. W. Bell, Inc. with a probe A-99-153. The gaussmeter has a rod-like axial probe connected to a gaussmeter body. At first, the developing sleeve 31 is directed in the horizontal direction (central axis of the sleeve is in horizontal direction) and fixed. Then, the probe directed in the horizontal direction is disposed perpendicular to the sleeve (central axis of the probe is in the horizontal direction and perpendicular to the central axis of the sleeve) while a distal end portion (measuring section) of the probe is opposed to the surface of the sleeve with slight clearance. Further, centers of the developing sleeve 31 and the probe are disposed on the same horizontal plane and fixed. While keeping the above configuration, the magnetic flux density is measured as the magnet roller 32 is rotated. Since the magnet roller 32 is a tubular member approximately concentric with the developing sleeve 31, a surface position of the developing sleeve 31 and the magnetic flux density in the normal direction of the surface position can be measured in every position in the circumferential direction. The peak densities in every position are obtained from the data of measured magnetic flux density in the circumferential direction and represented as Br. That is, Br is a vertical direction component of the magnetic flux density on the surface of the developing sleeve 31. Next, the probe disposed perpendicular to the sleeve as described above is moved such that the distal end of the probe is rotated 90 degree and directed along the tangential line of the circumferential surface of the developing sleeve 31, and then fixed. While keeping that configuration, the magnetic flux density of the surface position of the developing sleeve 31 in the direction of the tangential line is measured as the magnet roller 32 is rotated. The peak densities in every position are obtained from the data of measured magnetic flux density in the circumferential direction and represented as BΘ. That is, BΘ is a horizontal direction component of the magnetic flux density on the surface of the developing sleeve 31.

Based on |Br| and |BΘ| obtained in every position, the magnitude |B| of the magnetic flux density B of the surface of the developing sleeve 31 is calculated by $|B|=|Br^2+B\Theta^2|^{1/2}$. Magnitudes |B| obtained in every position on the surface of the developing sleeve 31 can be plotted like FIG. 15A in which South pole is placed in positive area and North pole is placed in a negative area. As shown in FIG. 15B, the magnet roller 32 of the sixth embodiment is configured such that the relation of |Br|<|BΘ| is established at each of positions corresponding to the intersections q and q2 on the surface of the developing sleeve 31. That is, the intersections q and q2 are located between intersections u1 and u2 of |Br| and |BΘ| in FIG. 15B where |Br|<|BΘ| is established. In the region where that relation is established, the horizontal magnetic field is more dominant than the vertical magnetic field. That is, the toner in that region is easily conveyed by the rotation of the developing sleeve 31. On the contrary, in the region where the relation of |Br|>|BΘ| is established the vertical magnetic field is more dominant than the horizontal magnetic field, therefore a toner accumulation is easily formed on the surface of the developing sleeve 31.

By using the magnet roller 32 with above explained pole assignment and magnetic force distribution and employing above described arrangement of each members, toner and paper powder in the developing apparatus 3 move as shown in FIG. 16B. The conveying force of the toner conveying member 34 is directed in the direction of the elongation line r or r2. That is, most of the toners and paper powders in the toner storage chamber 300 are carried to the developing sleeve 31 along the elongation line r or r2, and then the large portion of them reach the intersection q or q2.

Here, for effective toner supply, in the rotational direction of the developing sleeve 31, the intersections q and q2 are located between lowest point p of the developing sleeve in the gravity direction and the regulating section e. Preferably, the intersections q and q2 are near the lowest point p for preventing the paper powder from being carried to the regulating section 3 directly by the toner conveying member 34.

Since the magnetic flux density relation on the intersection q is |Br|<|BΘ| and therefore the horizontal magnetic force is dominant on each of intersections q and q2, the toner, which is carried on the surface of the developing sleeve 31 by the toner conveying member 34, can be effectively carried to the regulating section e by the rotation of the developing sleeve 31 as shown by the arrow C5 in FIG. 16B. In addition, the paper powder not having magnetism drops in the gravity direction as shown by arrow D5 in FIG. 16B and is carried to the toner storage chamber 300. Note that, if the magnetic flux density relation on the intersections q and q2 are |Br|>|BΘ| and therefore the vertical magnetic force is dominant, the toner accumulation is easily formed on the intersections q and q2 and the paper powder is mixed in the toner accumulation. As a result, the paper powder is carried to the regulating section e together with the toner by the rotation of the developing sleeve 31.

As explained above, since the intersections q and q2 are located between the lowest point p and the regulating section e and the magnetic flux density relation on the intersection q is |Br|<|BΘ|, the paper powder cannot stay in the vicinity of the developing sleeve 31. In addition, since the toner and paper powder cannot be directly supplied to the vicinity of the regulating section e from the toner storage chamber 300, it is possible to suppress a risk that the paper powder is held between the developing sleeve 31 and the regulating blade 33 and passes through the regulating section e.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2014-028617, filed on Feb. 18, 2014, No. 2014-245404, filed on Dec. 3, 2014, No. 2015-025629, filed on Feb. 12, 2015, and No. 2015-026931, filed on Feb. 13, 2015 which are hereby incorporated by reference herein in their entirety.

What is claimed is:

1. A developing apparatus comprising:

a developer bearing member configured to bear a developer on a surface;

a regulating member configured to regulate a layer thickness of the developer borne on the surface of the developer bearing member;

a conveying member configured to convey the developer; and a frame having a development chamber in which the developer bearing member and the regulating member are provided, a storage chamber in which the conveying member is provided and the developer is stored, and an opening through which the developer being conveyed by the conveying member from the storage chamber passes into the development chamber, the developing apparatus collecting the developer remaining on an image bearing member into the storage chamber, after the developer on the image bearing member is transferred onto a transfer material, wherein, in a cross section perpendicular to the longitudinal direction of the developer bearing member, a cross sectional area of the storage chamber is larger than that of the development chamber, wherein, when a developing operation is performed, a contact region between the developer bearing member and the regulating member is located directly above the opening in a vertical direction and the developer scraped off from a surface of the developer bearing member at the contact region falls into the storage chamber, and wherein the regulating member includes a protruded portion protruding to the developer bearing member side between a distal end portion and an opposite end portion of the regulating member, the protruded portion being in contact with the developer bearing member such that a first gap is formed between a first part of the regulating member, which is closer to the distal end portion than the protruded portion, and the developer bearing member, and a second gap is formed between a second part of the regulating member, which is closer to the opposite end portion than the protruded portion, and the developer bearing member.

2. The developing apparatus according to claim 1, wherein, when the developing operation is performed, a bottom section of the development chamber is located above a bottom section of the storage chamber in a vertical direction.

3. The developing apparatus according to claim 1, wherein the developer is a one component developer.

4. The developing apparatus according to claim 1, wherein the developing apparatus collects the developer remaining on the image bearing member into the storage chamber as a cleaner-less system.

5. The developing apparatus according to claim 1, wherein the regulating member includes a step portion with the first gap, and a corner portion of the step portion comes in contact with the developer bearing member.

6. The developing apparatus according to claim 1, wherein the regulating member includes a supporting section and a conductive member that covers the supporting section, and the conductive member comes in contact with the developer bearing member.

7. The developing apparatus according to claim 1, wherein an axial center of the developer bearing member, which is rotatably provided, is located above an axial center of the conveying member, which is rotatably provided, in the vertical direction.

8. The developing apparatus according to claim 1, wherein the contact region is located above an axial center of the conveying member, which is rotatably provided, in the vertical direction.

9. The developing apparatus according to claim 1, wherein a rotating direction of the developer bearing member is a direction from a lower end portion to an upper end portion of the opening in a portion where the developer bearing member opposes the opening.

10. The developing apparatus according to claim 1, wherein average circularity of the developer is equal to or higher than 0.93.

11. The developing apparatus according to claim 1, wherein a degree of agglomeration of the developer is equal to or lower than 55.

12. The developing apparatus according to claim 1, wherein the developer is a magnetic developer.

13. A cartridge detachably provided in a main body of an image forming apparatus that performs image formation, the cartridge comprising:

the developing apparatus according to claim 1; and an image bearing member to which the developer is supplied by the developer bearing member to develop an electrostatic latent image formed on a surface of the image bearing member into a developer image.

14. An image forming apparatus that performs image formation, comprising:

the developing apparatus according to claim 1; and an image bearing member to which the developer is supplied by the developer bearing member to develop an electrostatic latent image formed on a surface of the image bearing member into a developer image.

15. The image forming apparatus according to claim 14, further comprising a transfer member provided in contact with the image bearing member and configured to transfer the developer image onto a transfer material.

16. The developing apparatus according to claim 1, wherein the frame comprises a first frame body and a second frame body, wherein the first frame body constitutes a part of the development chamber and includes the opening.

17. The developing apparatus according to claim 1, wherein the frame comprises a first frame body and a second frame body, wherein the first frame body constitutes a part of the development chamber and includes the opening, and the second frame body constitutes a part of the storage chamber.

18. The developing apparatus according to claim 1, wherein the frame comprises a first frame body and a second frame body, wherein the first frame body constitutes a part of the development chamber and includes the opening, and when viewed in a rotation axis direction of the developer bearing member, a line drawn downward in the gravity direction from the contact region crosses the second frame body.

19. The developing apparatus according to claim 5, wherein the regulating member includes the protruded portion having a curved surface, as the step portion.

* * * * *